US005984469A

United States Patent [19]

Koike et al.

[11] Patent Number: 5,984,469

[45] **Date of Patent: *Nov. 16, 1999**

[54] RECORDING APPARATUS

[75] Inventors: Yasushi Koike, Tokyo; Yoji Ara, Yokohama; Masaaki Kakizaki, Kawasaki, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/361,228

[22] Filed: Dec. 21, 1994

[30] Foreign Application Priority Data

| | | | |
|---|---|---|---|
| Dec. 30, 1993 | [JP] | Japan | 5-354508 |
| Nov. 30, 1994 | [JP] | Japan | 6-296949 |

[51] Int. Cl.[6] ..... B41J 2/01

[52] U.S. Cl. ..... 347/104

[58] Field of Search ..... 347/8, 16, 104; 400/605, 608.2; 346/134; 271/9.1, 273, 265.01, 275

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,452,543 | 6/1984 | Adkisson et al. | 271/9.1 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,564,305 | 1/1986 | Rekewitz | 271/9.1 |
| 4,608,577 | 8/1986 | Hori | 347/66 |
| 4,740,796 | 4/1988 | Endo et al. | 347/56 |
| 5,118,090 | 6/1992 | Sonoda et al. | 271/117 |
| 5,129,646 | 7/1992 | Miyakawa | 271/273 |
| 5,141,346 | 8/1992 | Nakagawa | 400/634 |
| 5,158,380 | 10/1992 | Hauslaib et al. | 400/605 |

FOREIGN PATENT DOCUMENTS

| | | |
|---|---|---|
| 0099958 | 7/1982 | European Pat. Off. . |
| 0227116 | 12/1986 | European Pat. Off. . |
| 0358192 | 9/1989 | European Pat. Off. . |
| 0549989 | 12/1992 | European Pat. Off. . |
| 54-56847 | 5/1979 | Japan . |
| 54-123670 | 7/1984 | Japan . |
| 59-138461 | 8/1984 | Japan . |
| 63-084958 | 8/1988 | Japan . |

*Primary Examiner*—N. Le
*Assistant Examiner*—Judy Nguyen
*Attorney, Agent, or Firm*—Fitzpatrick, Cella, Harper & Scinto

[57] ABSTRACT

A recording apparatus with a recording unit for recording an image on a recording medium in consonance with an image signal, a feeder for feeding the recording medium to the recording unit, first auxiliary feeding unit, which contact the feeder when the recording medium is cut sheet paper, but which is separated from the feeder when the recording medium is continuous sheet paper in order to form a feeding route for the continuous sheet paper, second auxiliary feeding unit, which contacts the feeder when the recording medium is cut sheet paper, but which maintains a contact position with the feeder which decreasing pressure against the feeder when the recording medium is continuous sheet paper, and third auxiliary feeding unit, which contacts the feeder when the recording medium is cut sheet paper, but which decreases pressure against the feeder when the recording medium is continuous sheet paper, and switching device for selecting the forward or the backward movement of the first and the second auxiliary feeding unit to the feeder, whereby the sliding center of the first auxiliary feeding unit with respect to the feeder.

22 Claims, 25 Drawing Sheets

RECORDING APPARATUS

BACKGROUND OF THE INVENTION

1. Field of the Invention

The present invention relates to a recording apparatus that can perform high quality image recording. Recording performed by the present invention involves the application of ink to ink supports, such as cloth, paper, and sheet material. The present invention is applicable both to various data processing apparatuses and to printers that serve as output devices that perform the above recording.

2. Related Background Art

As personal computers, word processors, and facsimiles are widely used in offices, various types of recording apparatuses have been developed as output devices for them. Recording apparatuses that employ the ink jet system are especially widely used because they are compact and produce less noise while recording.

Recently, high recording quality has also begun to be required for recording apparatuses for personal use. The recording quality is determined by such factors as image density, density irregularities, and the sharpness of images. The reason is as follows.

In an ink jet recording apparatus, a recording head has a plurality of ink nozzles in perpendicular to a direction of feeding a recording medium, and ink ejects perpendicular to the face of a recording medium.

The ink ejection direction is supposed to be identical for all the nozzles, but in actuality, the directions from the nozzles may vary. FIG. 22 is a specific diagram for explaining the occurrence of a fuzzy image due to a variation in the direction ink is ejected from a recording head, which is employed in an ink jet recording apparatus. FIG. 23 is a specific diagram for explaining the occurrence of a fuzzy image due to different ink ejection speeds. For example, as is shown in FIG. 22, although ink should originally be ejected in the direction indicated by the dotted arrow A, the nozzles that emit ink face in the direction indicated by the solid line arrow B. When the interval between an ink ejection face 300*a* of a recording head 300 and a recording medium 301 is D1, the actual ink discharge point Q is shifted from the original ink discharge point P by a distance represented by the interval L1. This shift reduces image sharpness and degrades the recording quality. When the interval between the ink ejecting face 300*a* and the recording medium 301 is D2, for example, the shift is increased from L1 to L2 (L1<L2).

Besides the variance in the directions ink is ejected from the nozzles, differences in the speeds at which ink is ejected cause the fuzzy images. For example, ink droplets that are discharged from the nozzles are called main droplets, satellites, and micro dots, in order of size from the greatest. The ejection speeds for these ink droplets differ. Therefore, as is shown in FIG. 23, with the combination comprising the ink ejection speed V1 and the moving speed element VH for the recording head 300, ink is ejected in the direction indicated by the solid line arrow C; while with the combination comprising ink ejection speed V2 (V1<V1) and the moving speed element VH, ink is ejected in the direction indicated by the dotted line arrow D. The ink discharge directions are different and the sharpness of an image is deteriorated. The shift increases as the interval between the ink ejection face 300*a* and the recording medium 301 increases.

To improve the recording quality, it is demanded that an ink jet recording apparatus maintain a constant minimum interval between an ink ejection face and a recording medium.

In response to such a request, a conventional ink jet recording apparatus employs a recording medium pressing means for forcing down a recording medium so as to maintain the interval between the ink ejection face and the surface of the recording medium.

However, when the recording medium pressing means is separated from the recording medium at the time a recording medium jam occurs, or during the feeding of a continuous recording medium, the recording medium pressing means must provide a greater interval between the ink ejection face and the recording medium.

The arrangement of a conventional ink jet recording apparatus will now be explained in further detail while referring to FIGS. 24, 25A and 25B.

FIG. 24 is a perspective view illustrating the structure of a conventional ink jet recording apparatus, and FIGS. 25A and 25B are side views of a paper pressing mechanism of the conventional recording apparatus. In FIG. 24, an external cover C1 and an internal cover C2 are either opened or removed. In this recording apparatus, the recording medium 301, such as a normal sheet or a plastic sheet, is inserted through an insertion port 302, a motor (not shown) rotates a feeding roller 303, and the sheet is guided by paper pressing plates 304, which are the recording medium pressing means, and is fed toward a recording position. The recording head 300, which is a serial print type recording means, is mounted on a carriage 305. The carriage 305 engages a lead screw 306, and as the lead screw 306 rotates the carriage 305 reciprocates in the directions indicated by the arrow a in FIG. 24. The directions indicated by the arrow a are perpendicular to the direction in which the recording medium is fed.

In synchronization with the reciprocal movement of the carriage 305, the recording apparatus 300 on the carriage 305 moves in consonance with an image signal and discharges ink to the recording medium 301 to perform predetermined recording.

The structure and function of the paper pressing plates 304 that prevents the recording medium 301 from separating from the surface of the feeding roller 303 will now be described.

As is shown in schematic diagrams in FIGS. 25A and 25B, each of the paper pressing plates 304 is formed with an almost cylindrical bearing 304*a*, and a long arm 304*b* and a short arm 304*c*, both of which extend from part of the bearing 304*a*. A pinch roller 307 is rotatably attached to the distal end of the arm 304*b*. A release shaft 308 is rotatably provided in the bearing 304*a*. The arc portions of the release shaft 308 are regularly cut off longitudinally at predetermined intervals and the notched portions have D-shaped cross sections. One end 309*a* of a pressure spring 309 can abut upon the notched portion and the arched portion of the release shaft 308, or the short arm 304*c* of the paper pressing plate 304. The other end of the pressure spring 309 is fixed to the bottom of a chassis 310.

As is shown in FIG. 25A, when the release shaft 308 rotates and the end 309*a* of the pressure spring 309 contacts the notch of the release shaft 308, the rotation of the release shaft 308 is halted and the short arm 304*c* of the paper pressing plate 304 is forced by the pressure spring 309 in the direction indicated by the arrow b. The paper pressing plate 304 is rotated on the release shaft 308 and the pinch roller 307 presses against the surface of the feeding roller 303. As the feeding roller 303 is rotated, the pinch roller 307 is rotated in the direction opposite to that of the feeding roller 303.

When the release shaft 308 is rotated further and the end 309*a* of the pressure spring 309 contacts the arc of the release shaft 308, as is shown in FIG. 25B, the pressure spring 309 is pushed down in the direction indicated by the arrow c and the force exerted on the short arm 304*c* of the paper pressing plate 304 by the pressure spring 309 is released, so that the pinch roller 307 is separated from the surface of the feeding roller 303.

The separation of the paper pressing plate 304 from the feeding roller 303, i.e., the release of the pressure exerted by the pressure spring 309, can be performed as needed by manipulating a release lever 311 shown in FIG. 24 to rotate the release shaft 308.

In the above described embodiment, however, when the paper pressing plate 304 is released from the feeding roller 303 by manipulating the release lever 311, the paper pressing plate 304 is positioned closer to the recording head 300, as is shown in FIG. 25B, and the paper pressing plate 304 interferes with the approach of the recording head 300 to the recording head 301.

In the modern information society, a variety of recording media are supplied that cannot simply be classified only as normal paper, fanfold paper, and postcards. In addition to those, there are plastic sheet material, such as OHP film, cloth, threads, and a variety of other various ink support media on which ink is applied and that are supplied as recording media.

A recording apparatus example that can feed this plurality of recording medium types is disclosed in the specifications for U.S. Pat. No. 5,158,380.

The arrangement of the disclosed recording apparatus will now be described while referring to FIGS. 26A and 26B.

FIGS. 26A and 26B are cross sectional views for explaining the state when a cut sheet supply mode is selected, and FIG. 26B is a cross sectional view for explaining the state when a continuous sheet supply mode is selected.

In FIG. 26A, single sheets of paper 401 are supplied either from the bottom or the top of the apparatus. For paper supplied from the bottom of the apparatus, a cut sheet 401 is fed through a paper supply port 404 that is formed by a guide roller 407 and a friction roller 408. The friction roller 408 is held against a pressure spring 424 by a hub 423, one end 424*a* of the pressure spring 424 is driven by a cam 419 on a release shaft 421 to forcibly press the friction roller 408 against the guide roller 407. The cut sheet 401 that is held by the friction roller 408 and the guide roller 407 is fed to a recording position 414 in consonance with the rotation of the guide roller 407, and recording is performed on the cut sheet 401 by a recording head 415.

To supply the cut sheet 401 from the top of the apparatus, it is fed through a paper supply port 404 that is formed by the guide roller 407 and a friction roller 409. The friction roller 409 is supported by a bearing 425 that rides on a plurality of leaf springs 426. One end 426*a* of each of the leaf springs 426 is supported by a support plate 427 and the other end 426*b* is supported by a cam 420 on a release shaft 422 so as to exert sufficient force to press the friction roller 409 against the guide roller 407. The cut sheet 401 that is held between the friction roller 409 and the guide roller 407 is fed to the paper supply port 404, in consonance with the rotation of the guide roller 407, and is then fed to the recording position 414, in the same manner as is performed for the above described bottom paper supply, and recording is performed by the recording head 415.

In FIG. 26B, continuous paper 2 is supplied via a paper supply port 406 by a push tractor 412 from the rear or the back of the apparatus. The release shafts 421 and 422 are respectively rotated in the directions indicated by the arrows, and the force exerted by the pressure spring 424 and the leaf spring 426 on the respective friction rollers 408 and 409 is released or decreased. Accordingly, a paper feeding failure due to the perforations on the continuous paper can be prevented.

In the above described embodiment, however, paper is supplied through the paper supply port 404 or 406, some recording media are fed while adhering to the guide roller 407 while other recording media are fed along a sheet guide 418*a* of a body frame 418. A print start position in a paper feeding direction therefore varies from recording medium to recording medium.

Further, when feeding a thick recording medium, such as a post card, the forward edge of the recording medium may abut upon the paper guide 418*a* and cause the recording roller 409 to slip, so that a sheet supply failure occurs. To overcome this shortcoming, the pressure with which the friction roller 409 is pressed against the guide roller 407 has to be increased, so that even though paper feeding is possible, a greater than normal load accelerates the wear of the bearing 425 of the friction roller 409 and decreases its useful life span.

In addition, the interval between the surface of a fed recording medium and the ejection face of an ink jet head must be determined while considering the distortion of the surface of the recording medium that may occur due to a phenomenon called cockling. Cockling is a phenomenon where ink permeates the fibers of paper, etc., and expands the fibers so that the surface of the recording medium is distorted and undulating.

SUMMARY OF THE INVENTION

It is a first object of the present invention to provide a recording apparatus that comprises recording medium pressing means for ensuring that the surface of a recording medium remains flat in a recording area, and that can perform high quality recording without moving the recording medium pressing means toward a recording head even when the pressing means is in the released state.

It is a second object of the present invention to provide a recording apparatus that can maintain a constant print start position regardless of the paper type, such as cut sheet paper or continuous paper.

It is a third object of the present invention to provide a recording apparatus that ensures the feeding of a thick recording medium, such as a postcard.

To achieve the first object of the present invention, a recording apparatus cited in claim 1 comprises: recording means for recording an image on a recording medium in consonance with an image signal; feeding means for feeding the recording medium to the recording means; auxiliary feeding means, which is in contact with the feeding means when the recording medium is cut sheet paper and which is separated from the feeding means when the recording medium is continuous sheet paper; and switching means for selecting the forward or the backward movement of the auxiliary feeding means to the feeding means.

According to the present invention cited in claim 2, a recording apparatus cited in claim 1 further comprises pressure urging means for pressing the recording medium against the feeding means, and the pressure urging means is located either at a release position where pressure is almost released by the switching means or at a pressurizing position where pressure at the release position is gradually increased.

According to the present invention cited in claim 3, in a recording apparatus cited in claim 2, the withdrawal of the auxiliary feeding means is synchronized with the shift to the release position of the pressure urging means, and the advance of the auxiliary feeding means is synchronized with the shift to the pressure position of the pressure urging means.

To achieve the second and the third objects, according to the present invention cited in claim 4, in a recording apparatus cited in claim 3, the auxiliary feeding means includes: first auxiliary feeding means, which is provided upstream in the paper feeding direction, and which contacts the feeding means when the recording medium is cut sheet paper, but which is separated from the feeding means when the recording medium is continuous sheet paper in order to form a feeding route for the continuous sheet paper; second auxiliary feeding means, which is provided in the vicinity of the recording means, and which contacts the feeding means when the recording medium is cut sheet paper, but which while maintaining a contact position with the feeding means, decrease pressure against the feeding means when the recording medium is continuous sheet paper; and third auxiliary feeding means, which is provided almost mid way between the first and the second auxiliary feeding means, and which contacts the feeding means when the recording medium is cut sheet paper, but which decreases pressure against the feeding means when the recording medium is continuous sheet paper.

According to the present invention cited in claim 5, in a recording apparatus cited in claim 4, the switching means for switching the forward or the backward movement of the third auxiliary feeding means includes a long cam shaft and a lever that rotates the cam shaft.

According to the present invention cited in claim 6, a recording apparatus cited in claim 4 further comprises a paper sensor for detecting the presence of paper in the recording apparatus, and the paper sensor is located almost immediately following the third auxiliary feeding means in the paper feeding direction.

According to the present invention cited in claim 7, in a recording apparatus cited in claim 4, pressure forces that are applied by the first, the second, and the third auxiliary feeding means to the feeding means are independently set.

According to the present invention cited in claim 8, in a recording apparatus cited in one of claims 1 through 7, the feeding means is a roller that is elongated in a main scanning direction that is perpendicular to a feeding direction for the recording medium.

According to the present invention cited in claim 9, in a recording apparatus cited in claim 8, the recording means is mounted detachable from a conveying base that reciprocates along the main scanning directions.

According to the present invention cited in claim 10, in a recording apparatus cited in claim 9, a tank in which at least one kind of ink to be supplied to the recording means is retained is provided detachable from the recording means.

According to the present invention cited in claim 11, in a recording apparatus cited in one of claims 1 through 10, the recording means has an electrothermal energy conversion device, which generates thermal energy that causes film boiling of ink, that serves as an element that generates energy for ink ejection.

According to the present invention cited in claim 12, a recording apparatus comprises: recording means for recording an image on a recording medium in consonance with an image signal; feeding means for feeding the recording medium toward the recording means; first auxiliary feeding means, which is provided upstream in the paper feeding direction, and which contacts the feeding means when the recording medium is cut sheet paper, but which is separated from the feeding means when the recording medium is continuous sheet paper in order to form a feeding route of the continuous sheet paper; second auxiliary feeding means, which is provided in the vicinity of the recording means, and which contacts the feeding means when the recording medium is cut sheet paper, but which maintains contact with the feeding means while decreasing pressure against the feeding means when the recording medium is continuous sheet paper; and switching means for selecting the forward or the backward movement of the first and the second auxiliary feeding means relative to the feeding means, whereby the sliding center of the first auxiliary feeding means is provided on the side of the second auxiliary feeding means with respect to the feeding means.

According to the present invention cited in claim 13, a recording apparatus cited in claim 12 further comprises pressure urging means for pressing the recording medium against the feeding means, and the pressure urging means is located either at a release position where pressure is almost released by the switching means or at a pressurizing position where pressure at the release position is gradually increased.

According to the present invention cited in claim 14, in a recording apparatus cited in claim 13, the withdrawal of the first and the second auxiliary feeding means is synchronized with the shift to the release position of the pressure urging means, and the advance of the first and the second auxiliary feeding means is synchronized with the shift to the pressure position of the pressure urging means.

According to the present invention cited in claim 15, in a recording apparatus cited in claim 14, the switching means for switching the forward or the backward movement of the first and the second auxiliary feeding means includes a long cam shaft and a lever that rotates the cam shaft.

According to the present invention cited in claim 16, a recording apparatus cited in claim 15 further comprises third auxiliary feeding means, which is provided almost mid way between the first and the second auxiliary feeding means, and which contacts the feeding means when the recording medium is cut sheet paper, but which decreases pressure against the feeding means when the recording medium is continuous sheet paper.

According to the present invention cited in claim 17, a recording apparatus cited in claim 16 further comprises a paper sensor for detecting the presence of paper in the recording apparatus, and the paper sensor is located almost immediately following the third auxiliary feeding means in the paper feeding direction.

According to the present invention cited in claim 18, in a recording apparatus cited in claim 16, pressure forces that are applied by the first, the second, and the third auxiliary feeding means to the feeding means are independently set.

According to the present invention cited in claim 19, in a recording apparatus cited in one of claims 12 through 18, the feeding means is a roller that is elongated in a main scanning direction that is perpendicular to a feeding direction for the recording medium.

According to the present invention cited in claim 20, in a recording apparatus cited in claim 19, the recording means is mounted detachable from a conveying base that reciprocates along the main scanning directions.

According to the present invention cited in claim 21, in a recording apparatus cited in claim 20, a tank in which at least one kind of ink to be supplied to the recording means is retained is provided detachable from the recording means.

According to the present invention cited in claim 22, in a recording apparatus cited in one of claims 12 through 21, the recording means has an electrothermal energy conversion device, which generates thermal energy that causes film boiling of ink, that serves as an element that generates energy for ink ejection.

DETAILED DESCRIPTION OF THE PREFERRED EMBODIMENTS

The preferred embodiments of the present invention will now be described in detail while referring to the accompanying drawings.

Figure 1:
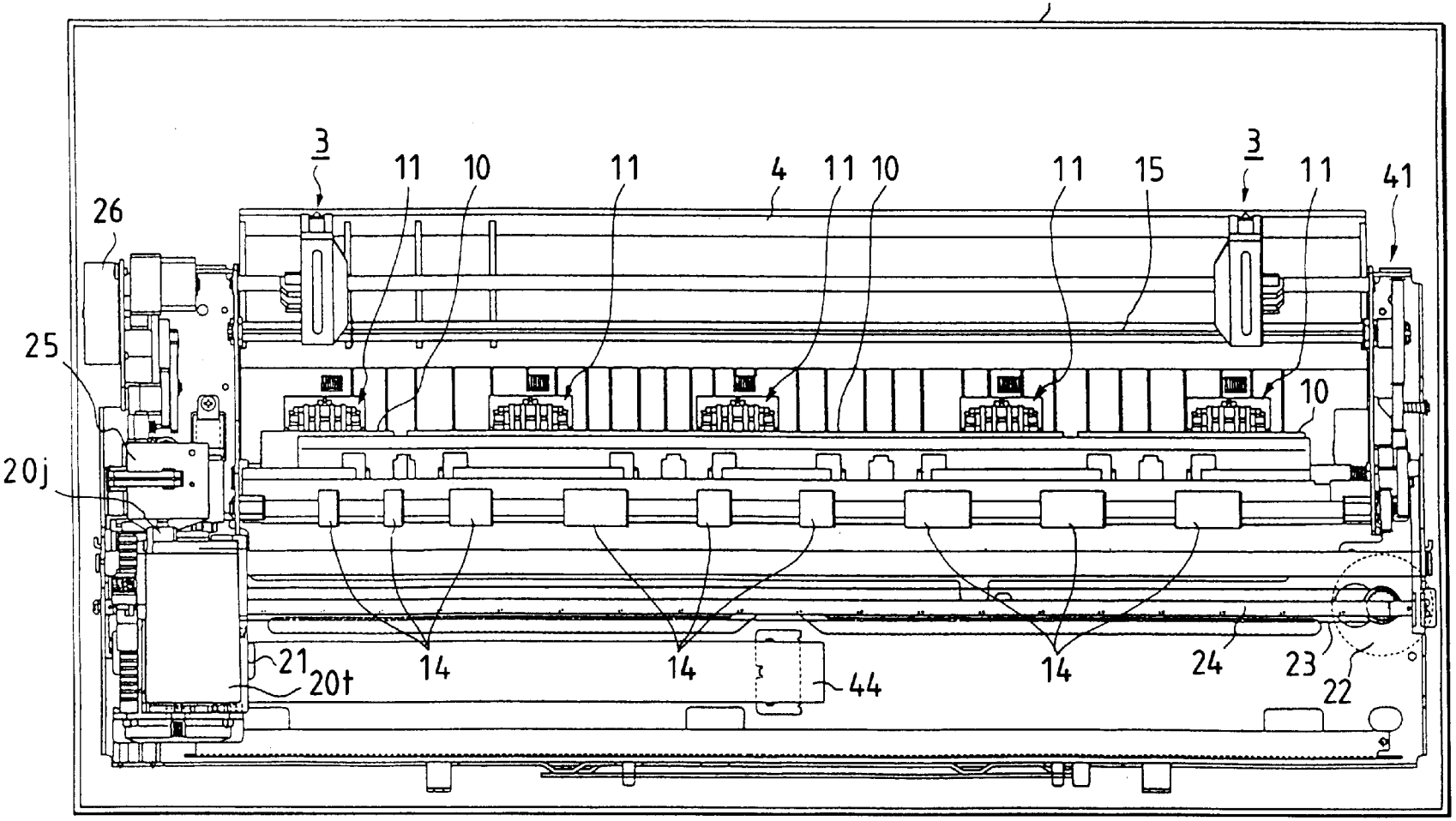
FIG. 1 is a top view illustrating the entire structure of a recording apparatus according to one embodiment of the present invention.
Figure 2:
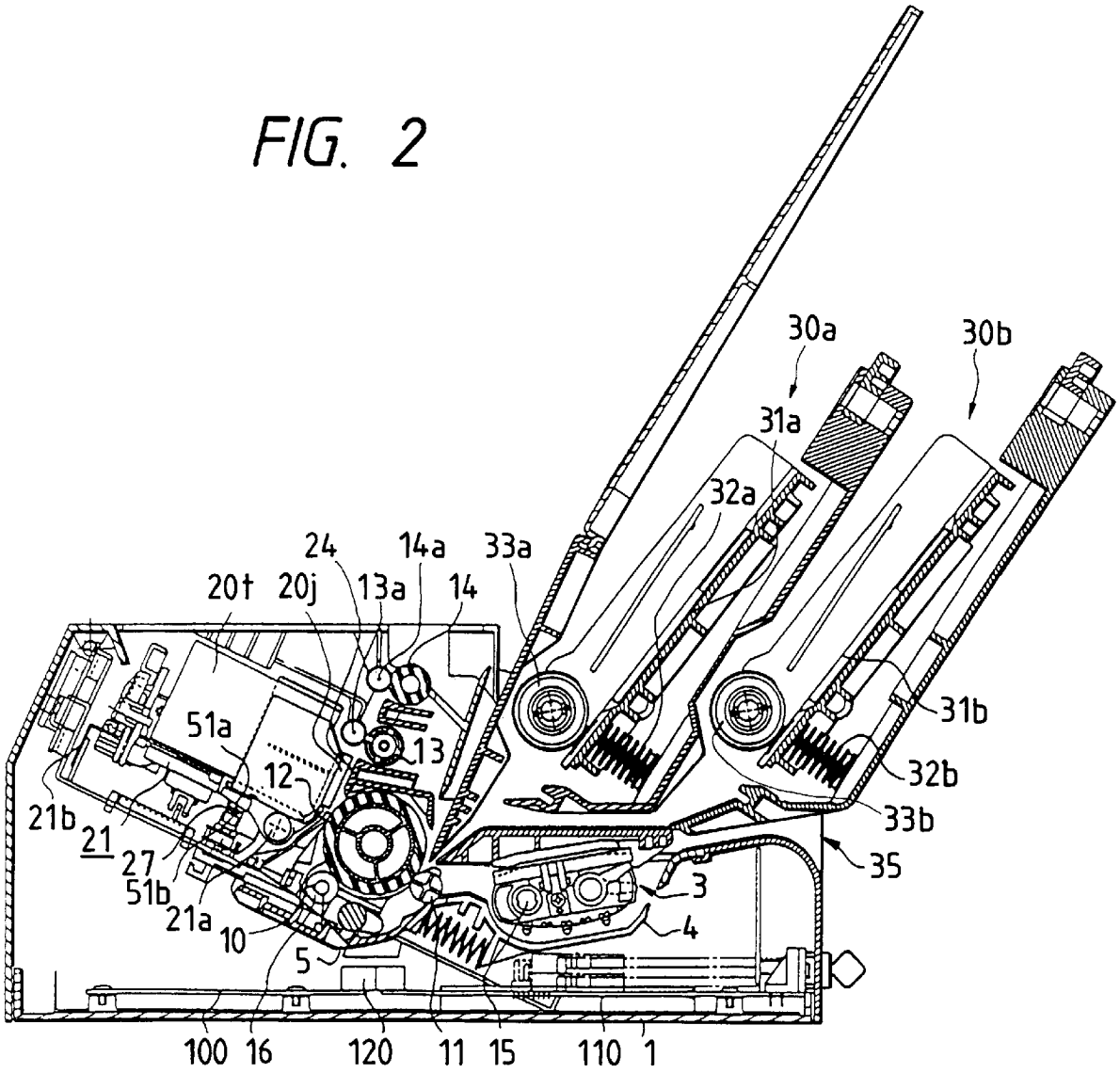
FIG. 2 is a cross sectional side view of the recording apparatus in FIG. 1 when an automatic paper feeder is installed in the apparatus.

FIGS. 1 and 2 illustrate an ink jet recording apparatus according to the first embodiment of the present invention. FIG. 1 is a top view for the general structure of the apparatus and FIG. 2 is a cross sectional side view for the state where an automatic paper feeding unit (hereafter referred to as an "ASF") is installed in the apparatus.

The ink jet recording apparatus in this embodiment can handle, as recording media, cut sheet paper, such as normal recording paper and post cards, and continuous sheet paper, such as fanfold paper.

Usually, cut sheet paper is supplied either by an ASF or manually. Since the ASF has two bins 30*a* and 30*b*, as is shown in FIG. 2, cassettes holding sheets of two different sizes, for example, can be set up at the same time and employed as desired by a user. The feeding mechanisms of the bins 30*a* and 30*b* are identical. More specifically, a plurality of cut sheets (not shown in FIG. 2) that are stacked on pressing plates 31*a* and 31*b* are forced by springs 32*a* and 32*b* toward pickup rollers 33*a* and 33*b*, respectively. As the pickup roller 33*a* or 33*b* is rotated in consonance with a feeding start command, the sheets are separated and fed one by one.

When cut sheet paper is employed as a recording medium, a resist roller 11 is set so that it can urge a feeding roller 10 by the manipulation of a release lever (not shown). The cut sheet that is supplied by the ASF is fed to a recording area along a feeding path that is formed around the feeding roller 10 as it is rotated. In the recording area, a paper pressing plate 12 is forced toward the feeding roller 10 by the elasticity of leaf springs. Here, the feeding force further acts on the cut sheet, which is fed between an ink jet head 20*j* and a platen 24. This feeding is performed intermittently for each scan by the ink jet head 20*j*, which will be described later, and the feeding distance corresponds to the row length, in a cut sheet feeding direction, of a plurality of ink ejection nozzles that are provided in the ink jet head 20*j*.

The cut sheet, which is fed every scan and on which recording is performed by the discharge of ink from the ink jet head 20*j*, is fed gradually upward within the apparatus and is finally discharged in consonance with the rotations of an assist roller 13 and a discharge roller 14 (and spurs 13*a* and 14*a* that are pressed by the respective rollers 13 and 14).

The ASF is not employed for continuous sheet paper. A continuous sheet that is supplied through a paper supply port 35 is fed by driving a pin tractor 3. The resist roller 11 is released by the release lever so that it is not pushed toward the feeding roller 10. The continuous sheet that is fed up to the recording area is shifted intermittently with every scan of the ink jet head 20*j*, in the same manner as is performed for the cut sheets, and is gradually transported upward within the apparatus. Recording is performed during this period.

An ASF motor 26 (see FIG. 1), which is provided in the apparatus body at the home position, is employed to drive a pickup roller of the ASF or an absorption pump in a capping unit 25. The driving power required for the feeding process of a recording medium, such as the drive force of the feeding roller 10, can be acquired via a gear row 41 (see FIG. 1) from an LF motor (not shown), which is located at the position opposite to the home position.

Figure 3:
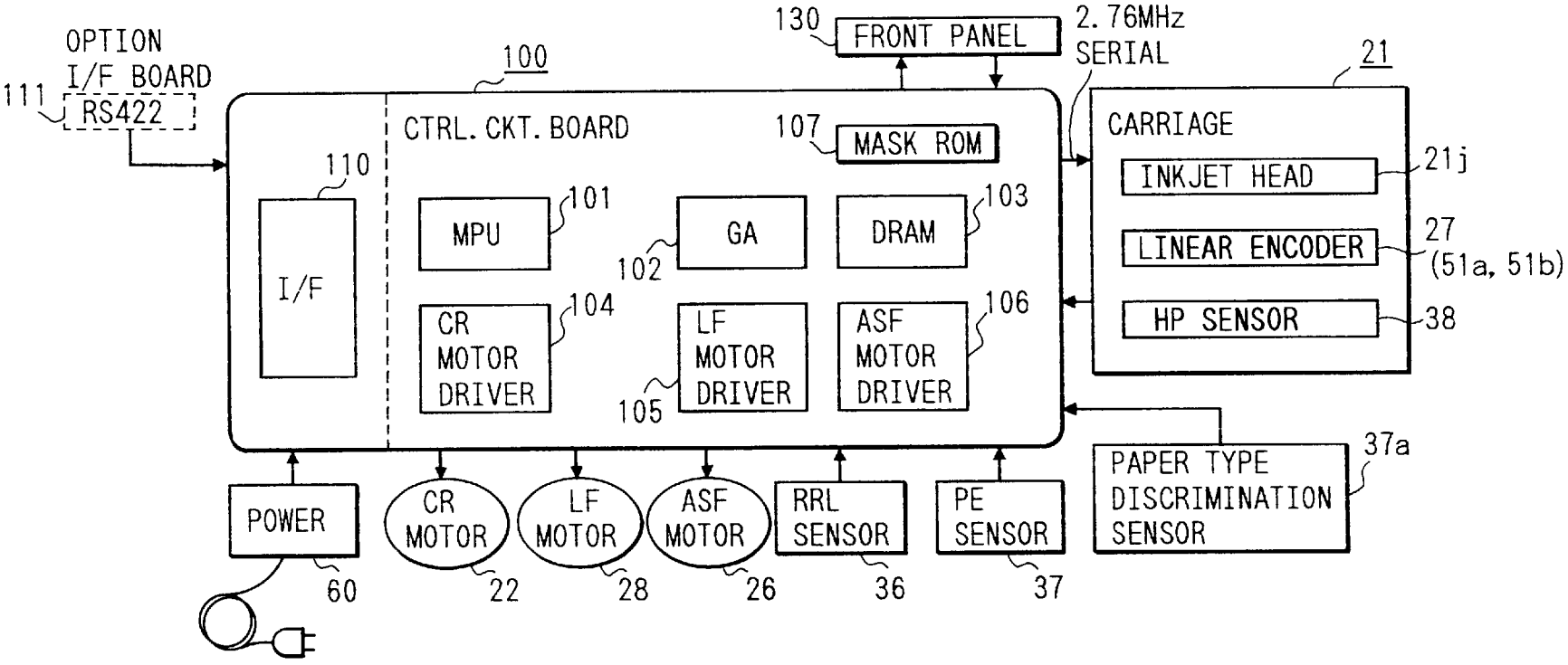
FIG. 3 is a block diagram mainly illustrating the control arrangement of the recording apparatus shown in FIGS. 1 and 2.

FIG. 3 is a block diagram that mainly illustrates the control arrangement of the ink jet recording apparatus shown in FIGS. 1 and 2.

A control circuit board 100, a print circuit board, is installed in the bottom of the apparatus body, as is shown in FIG. 2. An MPU 101, a gate array (GA) 102, a dynamic RAM (DRAM) 103, and a mask ROM (MASK ROM) 107 are provided on the control circuit board 100. Further, motor drivers, i.e., a carriage motor driver (CR motor driver) 104, a paper feeding motor driver (LF motor driver) 105, and an ASF motor driver 106, are provided on the control circuit board 100.

At the same time, a Centronics interface (IF) circuit board 110, which is formed as a print circuit board, is connected to the control circuit board 100 to enable the reception of recording data from a host device.

The MPU 101 of the control circuit board 100 executes data processing for the entire apparatus, the MASK ROM 107 is employed to store the procedures, and the DRAM 103 is employed as a work area for the above data processing. Various circuits that are involved in the process performed by the MPU 101 are packaged in the gate array 102. The MPU 101 converts image data, which are transferred from the host device via the I/F 110, into data that are employed by the ink jet head 20*j* to form an image by ink ejection, and then transfers the resultant data to the driver of the ink jet head 20*j* by the ejection timing of the ink jet head 20*j*. Further, the MPU 101 drives motors 22, 28 and 26 via the drivers 104, 105 and 106, respectively. The CR motor 22 is driven based on linear encoder information acquired via a carriage 21, while the ejection timing is controlled.

In addition, the MPU 101 executes a process for key entry and information display on a front panel 130 and a process in consonance with detection information that is received from a home position (HP) sensor 38, a tractor (RRL) sensor 36, a paper (PE) sensor, and a paper type discrimination sensor 37*a*.

The structure of a paper feeding (hereafter referred to as an "LF") mechanism of the recording apparatus shown in FIGS. 1 and 2 will now be explained.

Figure 4:
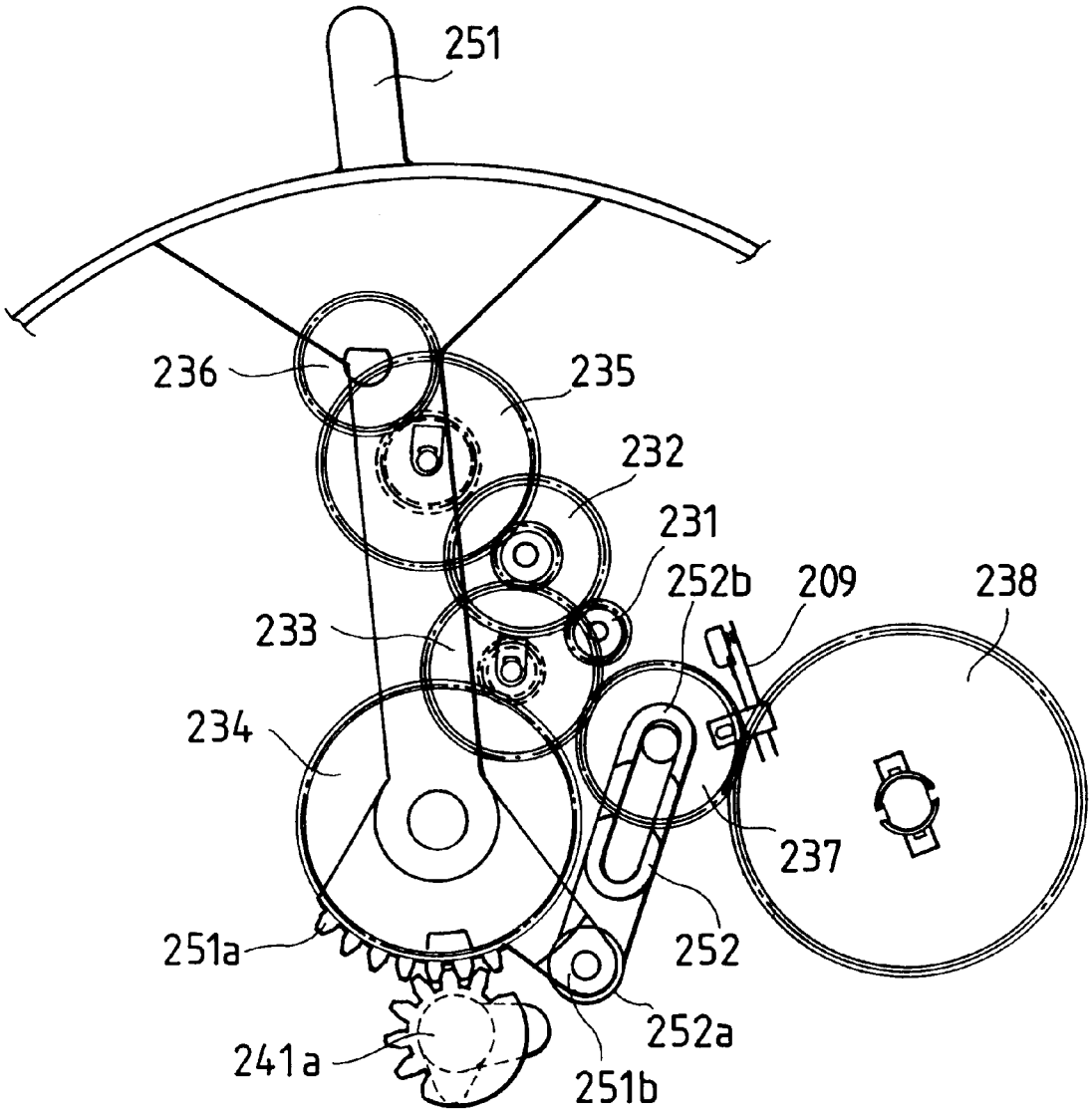
FIG. 4 is a side view for the arrangement of a paper feeding mechanism of the recording apparatus shown in FIGS. 1 and 2 when cut sheet paper is selected.
Figure 5:
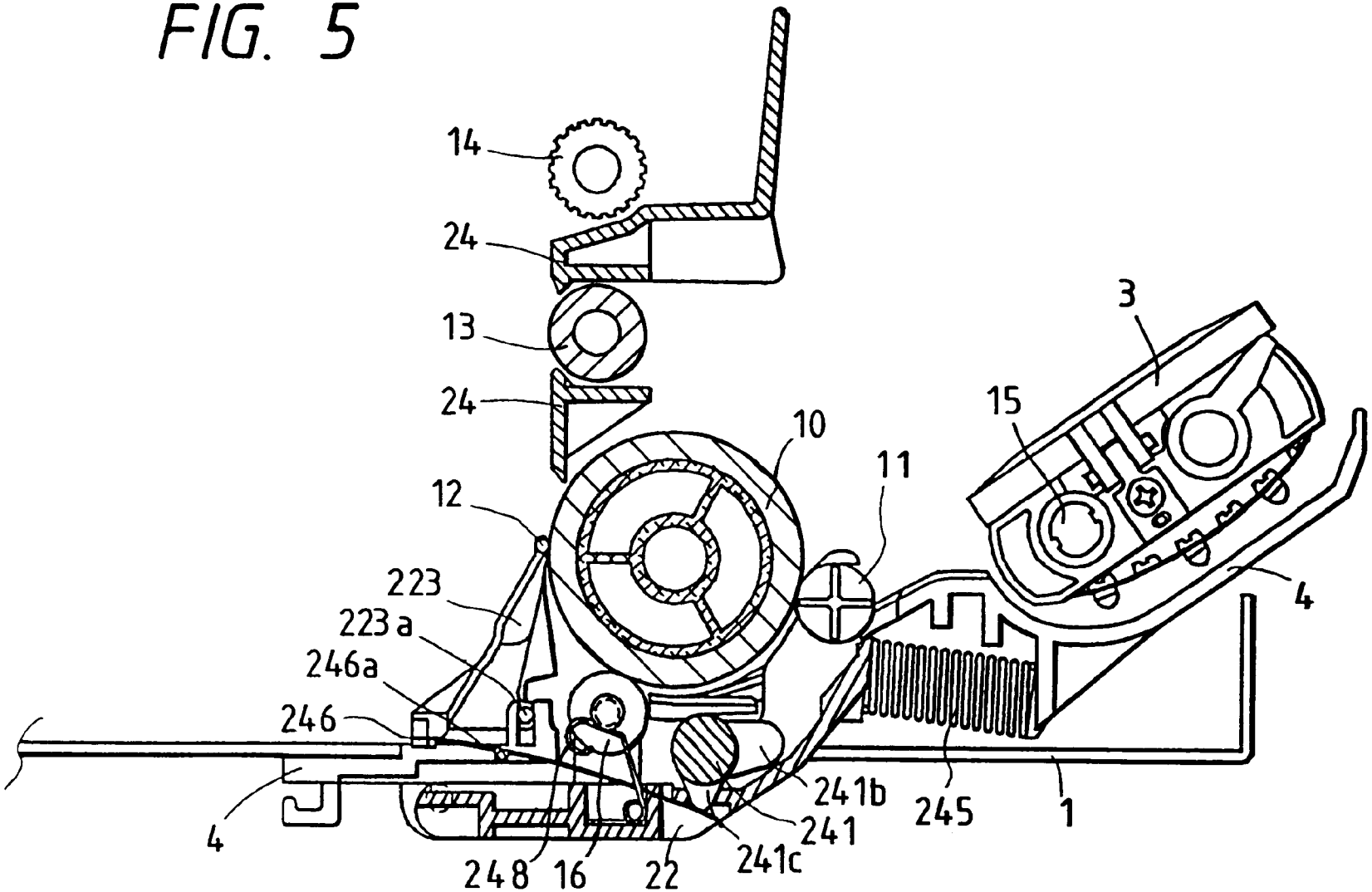
FIG. 5 is a cross sectional view of the paper feeding mechanism shown in FIG. 4.
Figure 6A:
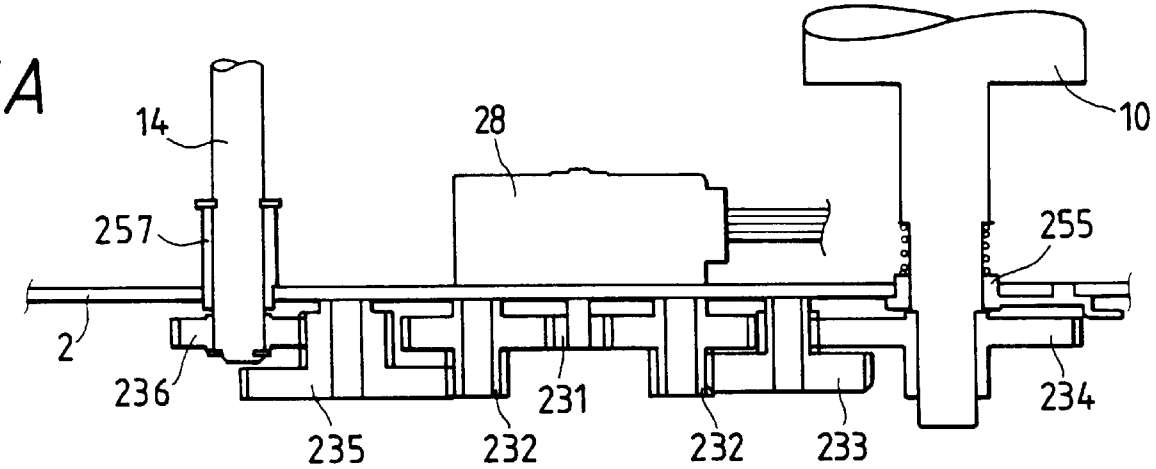
FIGS. 6A and 6B are development diagrams for the roller rows, with FIG. 6A showing how the drive force is transmitted to a feeding roller and FIG. 6B showing how the drive force is transmitted to a paper discharge roller.
Figure 10:
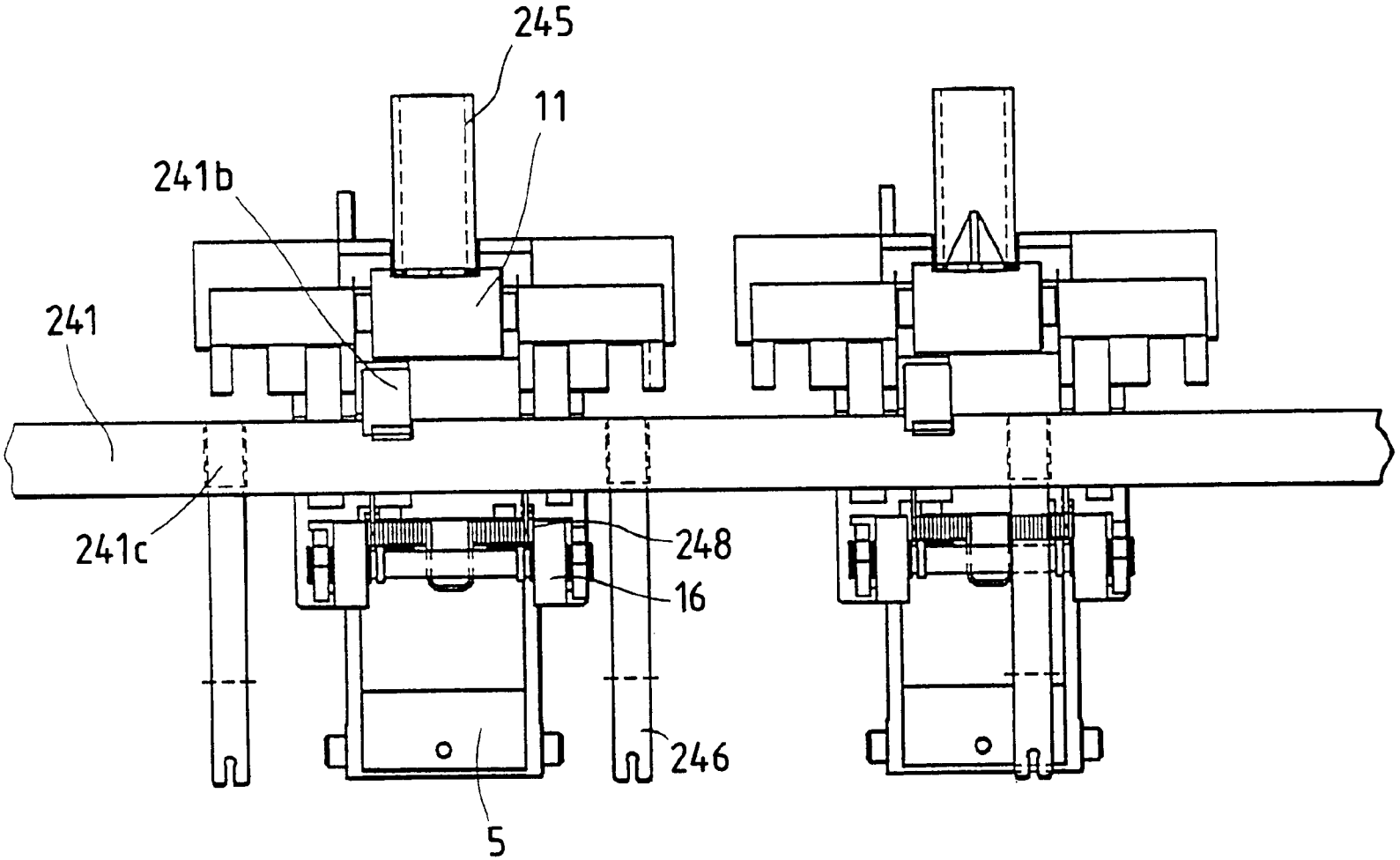
FIG. 10 is a top view illustrating the cam structure of a release shaft shown in FIGS. 5 and 8.

When cut sheet paper is selected as a recording medium, the release lever 251 is set to a cut sheet select state, as is shown in FIGS. 4 through 6, and then the resist roller 11 that is held by a resist roller holder 5 is pressed against the long feeding roller 10 by a resist roller spring 245 (see FIG. 5). Likewise, an auxiliary roller 16, which is held by the resist roller holder 5 so that it moves upward and downward, is pressed against the feeding roller 10 by an auxiliary roller spring 248, which is provided in the resist roller holder 5 (see FIG. 5). FIG. 10 is a top view illustrating the cam structure of the release shaft shown in FIG. 5. A pinch roller 12, which is supported by a shaft 223*a*, is held by a pinch roller holder 223, and is pressed against the feeding roller 10 by a pinch roller spring 246 (see FIG. 5). The pinch roller spring 246 is bent by a protrusion 241*c* of a release shaft 241, and generates a pressing force by the spring elasticity against its support point 246*a*.

The positional relationship between cams 241*b* and 241*c* of the release shaft 241 is as shown in FIG. 10. The cams 241*b* and 241*c* are so located that they do not interfere with each other.

Under these conditions, the drive force of the LF motor 28 is transferred to the feeding roller 10 and the discharge roller 14 (see FIG. 6).

The drive force imparted the feeding roller 10 is transferred via the series that comprises an LF motor gear 231, an deceleration gear 232, and an LF deceleration gear 233, and to a feeding roller gear 234, which is inserted into the feeding roller 10, so that the feeding roller 10 is rotated.

The drive force to the discharge roller 14 is transferred via the series that comprises the LF motor gear 231, the deceleration gear 232, and an LF deceleration gear 235 to a discharge roller gear 236, which engages the discharge roller 14, so that the discharge roller 14 is rotated.

Since the feeding roller 10 employed in this embodiment is elongated in the main scanning direction, distortion can be completely eliminated for a large sized sheet.

In addition, the rotation speed of the discharge roller 14 is higher than that of the feeding roller 10 in this embodiment to ensure that at a recording position a recording medium will be flat. More specifically, with a feeding roller diameter of $\phi$38.808 (0, −0.06), a discharge roller diameter of $\phi$15.515 (±0.03), a deceleration rate of the feeding roller of 1/36, and a deceleration rate of the discharge roller of 1/15, the rotation speed of the discharge roller is increased about 1% (0.08% to 1.19% while considering crossing).

Figure 6B:
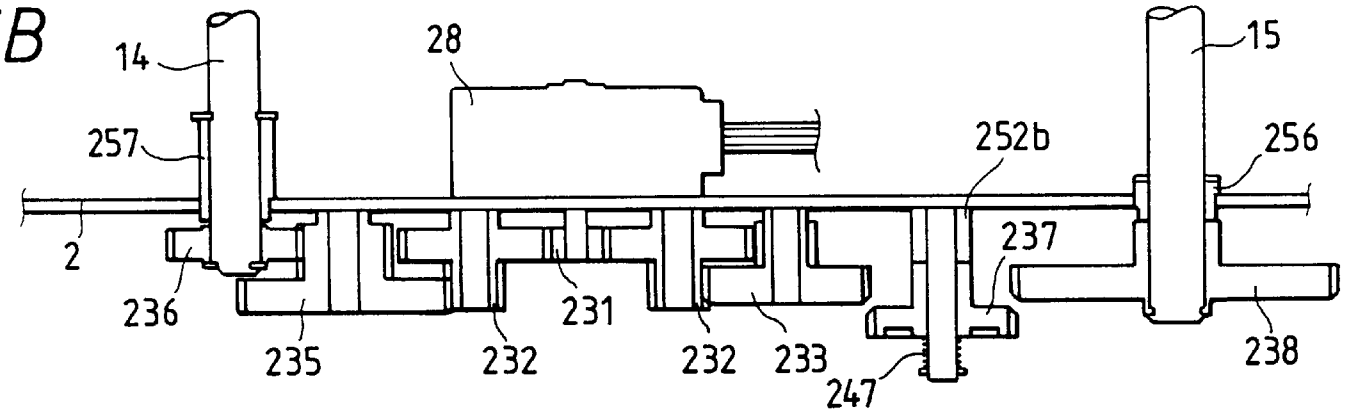

As for the transfer of the drive force of the LF motor 28 to the pin tractor 233, the drive force is transferred via the LF motor gear 231 and the deceleration gear 232 to the LF deceleration gear 233, and not up to the pin tractor 3 because the transfer between the LF deceleration gear 233 and a clutch gear 237 is cut off. More specifically, the clutch gear 237 is pushed toward a frame 2 side (in a direction where the LF deceleration gear 233 is connected) by a clutch spring 247, which is shown in FIG. 6B. The clutch gear 237 is, however, separated from the LF deceleration gear 233 against the urging force exerted by a cam 252*b* of a slide cam 252 that interlocks with the release lever 251.

The arrangement of the LF driving mechanism when continuous sheet paper is selected will now be described.

Figure 7:
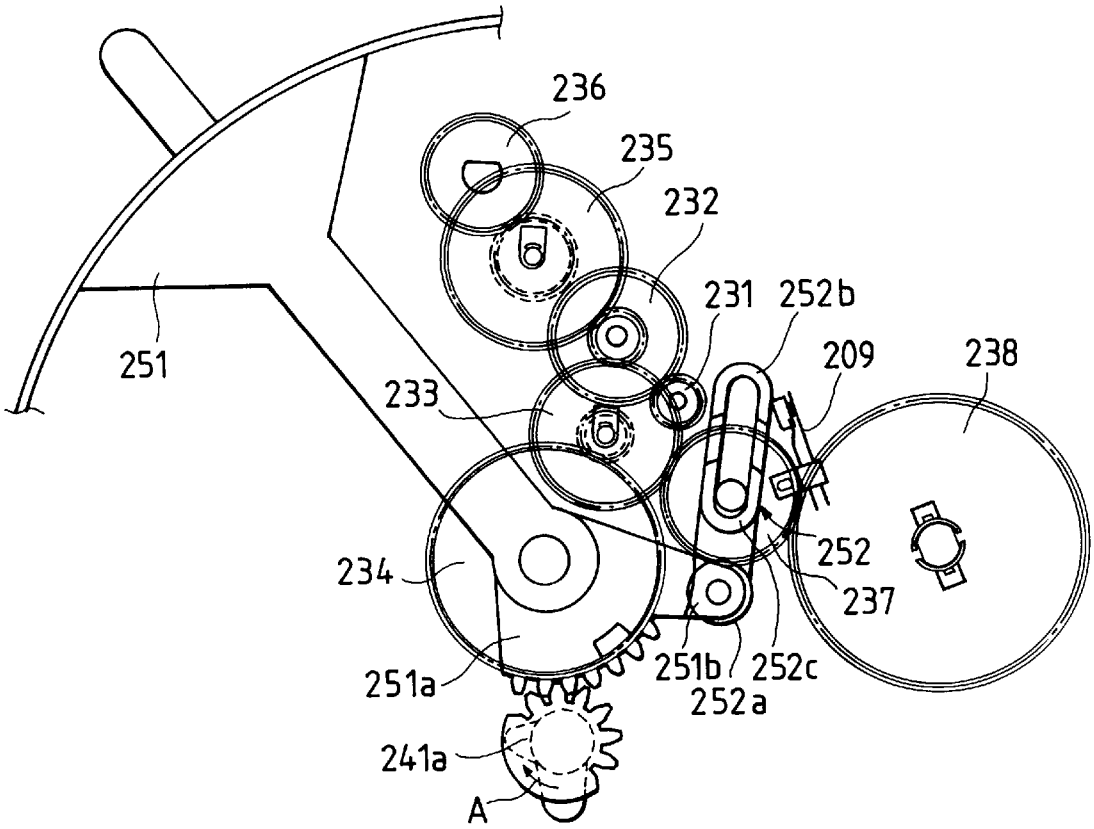
FIG. 7 is a side view for the arrangement of a paper feeding mechanism of the recording apparatus shown in FIGS. 1 and 2 when continuous sheet paper is selected.

When the release lever 251 is pulled down to set the apparatus in the continuous sheet select state, as is shown in FIG. 7, a gear 241*a* of the release shaft 241, which engages a gear 251*a* of the release lever 251, is rotated in the direction indicated by the arrow A.

Figure 8:
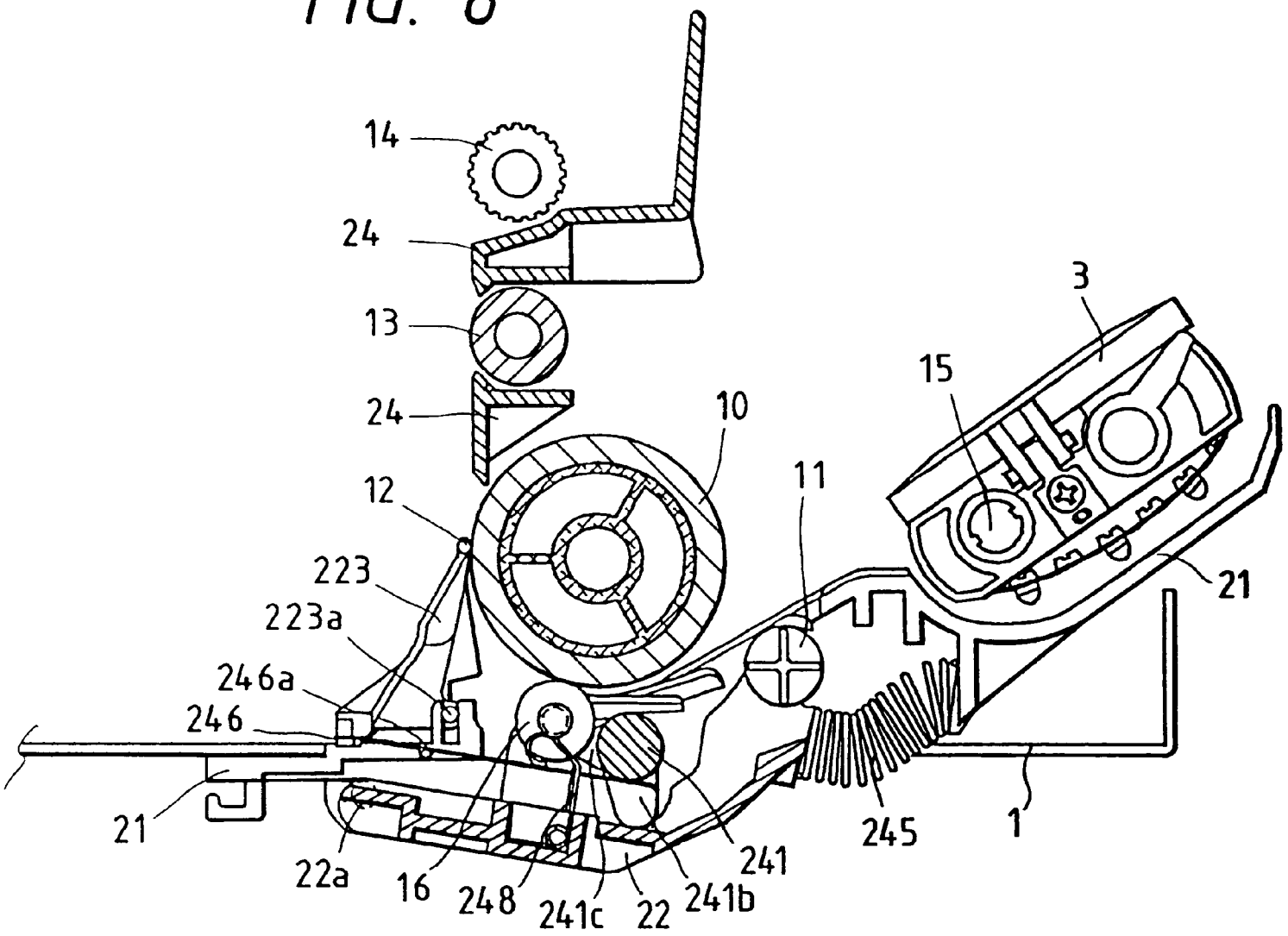
FIG. 8 is a cross sectional view of the paper feeding mechanism in FIG. 7.

As the release shaft 241 is rotated, as is shown in FIG. 8, its protrusion 241*b* pushes the resist roller holder 5 down to separate the resist roller 11 from the feeding roller 10 and to remove the resist roller 11 from the paper feeding path. A rotation support point 22*a* of the resist roller holder 5 is provided on the side of the pinch roller holder 223. Even when the auxiliary roller 16, which is held by the resist roller holder 5 so that it moves up and down, also moves in a direction where it separates from the feeding roller 11, it merely weakens the pressing force to the feeding roller 10 because of the auxiliary roller spring 248.

Further pressure by the protrusion 241*c* on the pinch roller spring 246 is released, and the pressing force of the pinch roller 12 on the feeding roller 10 is accordingly reduced.

As is described above, even in the continuous sheet select state, the pressing forces of the pinch roller 12 and the auxiliary roller 16 on the feeding roller 10 are not set to "0". The individual reasons will now be explained.

As for the reduced pressure by the pinch roller on the feeding roller 10, although the accuracy in feeding continuous sheet paper is controlled by the pin tractor 3, the pinch roller 12 is sometimes separated from the surface of the feeding roller 10 at page boundaries (perforations), and proper pressure is therefore required to prevent this phenomenon.

As for the reduced pressure exerted by the auxiliary roller 16 on the feeding roller 10, it is necessary to decrease the allowable difference, of a paper position that is detected by a paper sensor, that is caused by a weight percentage of a sheet (represented by grammage or ream weight) or by a thickness difference in paper types.

Figure 11:
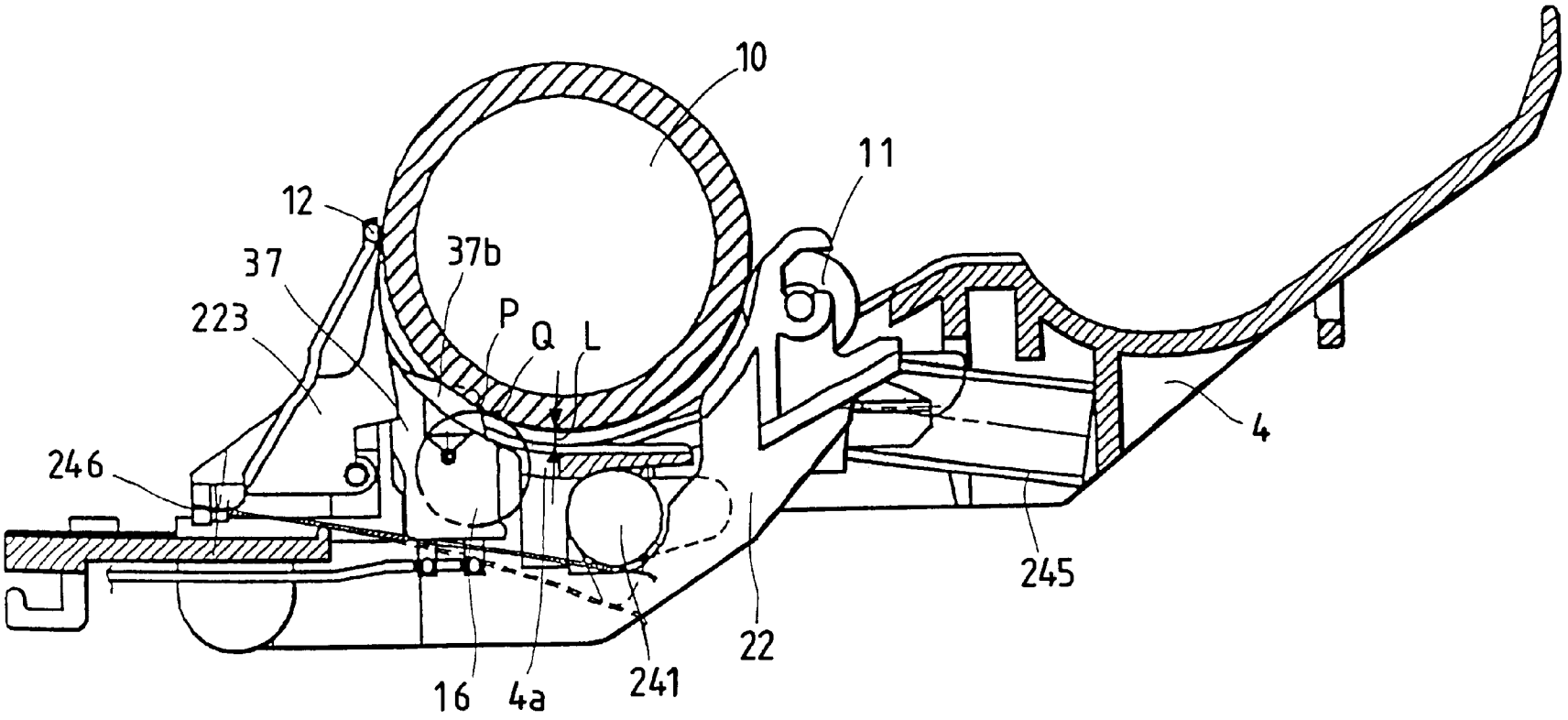
FIG. 11 is a cross sectional view for explaining the location of a paper sensor in the paper feeding mechanism of the recording apparatus shown in FIGS. 1 and 2 when cut sheet paper is selected.

As is shown in FIG. 11, depending on the thickness of a sheet, some sheets are fed while wrapped around the feeding roller 10, and other sheets are fed along a feeding roller opposing portion 4*a* of a paper pan 4. Supposing that an interval between the feeding roller 10 and the feeding roller opposing portion 4*a* of the paper pan 4 is L, an allowable feeding difference may be a maximum 2L.

Supposing that a detection position of a flag 37*b* of the paper sensor 37 is P and a contact point of the auxiliary roller 16 and the feeding roller 10 is Q, the auxiliary roller is so positioned that P is always located downstream of Q in a paper feeding direction. When the paper sensor detects a sheet, the sheet is always located on the feeding roller 10 and the allowable detection difference can be reduced.

In this embodiment, the pressure force of the pinch roller 12 exerted on the feeding roller 10 is 1200 g in the cut sheet select mode, and 200 g in the continuous sheet select mode.

The pressure force of the auxiliary roller 16 exerted on the feeding roller is 75 g in the cut sheet select mode, and 20 g in the continuous sheet select mode.

Further, the recording apparatus in this embodiment is so designed that the pressure can be varied as needed. In other words, the apparatus comprises pressure adjusting means. The pressure adjusting means includes a mechanism that selects a position at which pressure is released and a position at which pressure is gradually increased from the release position. The pressure adjusting means may also have a mechanism wherein one end of a helical coil spring, for example, which applies pressure to the pinch roller, contacts the external surface of a rotary shaft, which has a notch, and the other end of the coil spring is secured; and wherein as the shaft is rotated, the contact position is altered either to the external surface of the shaft or the notch to select the release position or the pressure position.

The drive force of the LF motor 28 in the continuous sheet select mode is transferred individually toward the feeding roller 10, the discharge roller 14, and the pin tractor 3.

Since the transfer to the feeding roller 10 and to the discharge roller 14 is the same as is performed in the cut sheet select mode, no explanation for it will be given.

Figure 9A:
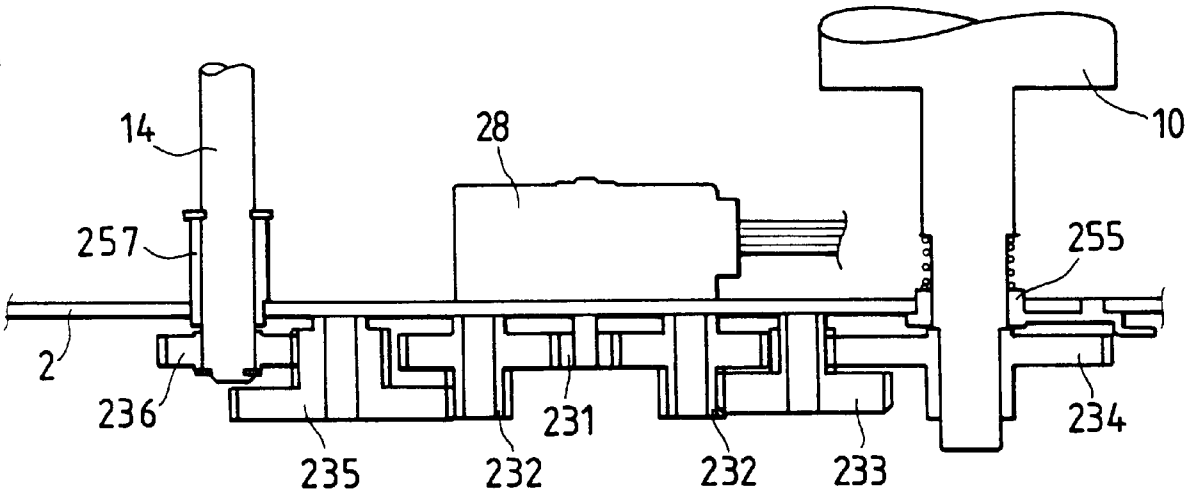
FIGS. 9A and 9B are development diagrams for the roller rows, with FIG. 9A showing how the drive force is transmitted to a feeding roller and FIG. 9B showing how the drive force is transmitted to a paper discharge roller.
Figure 9B:
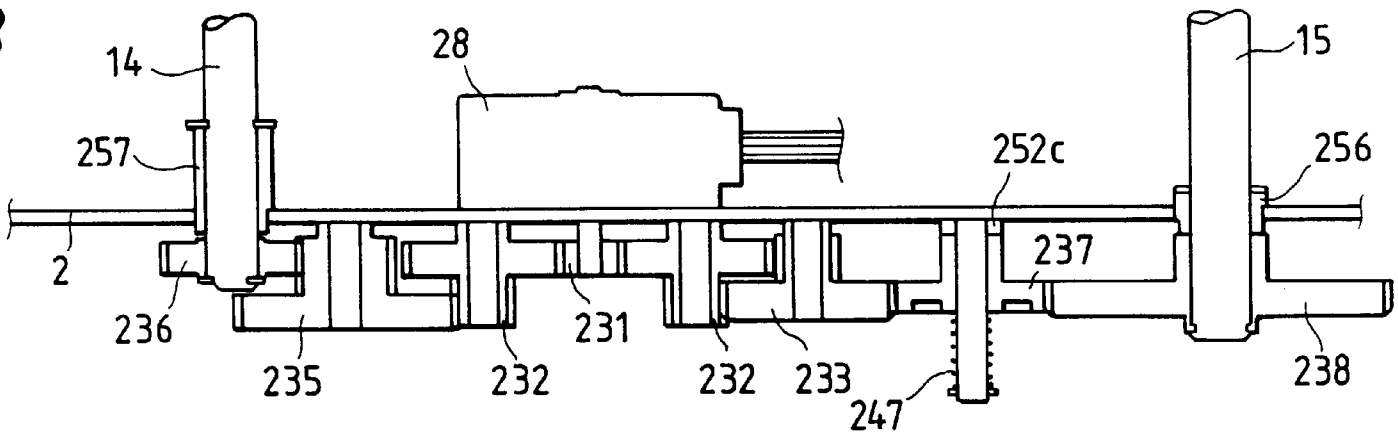

As for the pin tractor 3, the drive force is transferred from the row that comprises the LF motor gear 231, the deceleration gear 232, the LF deceleration gear 233, and the clutch gear 237 to a tractor gear 238 that engages a tractor shaft 15, which is in turn rotated to transfer the drive force to the pin tractor 3 (see FIGS. 9A and 9B). More specifically, although the clutch gear 237 is pressed toward the frame 2 side by the clutch spring 247, in the continuous sheet select mode the clutch gear 237 is coupled with the LF deceleration gear 233 and to the tractor gear 238 by the cam 252*c* of the slide cam 252.

Simultaneously, the side portion of the slide cam 252 acts on the tractor sensor 209, and the sheet select mode is changed from the cut sheet select mode to the continuous sheet select mode.

As is described above, according to the present invention, a recording medium can be maintained flat both during the feeding and the recording regardless of whether the recording medium is cut sheet paper or continuous sheet paper, and paper distortion can be prevented, so that high quality image recording can be provided. Further, according to the present invention, a constant print start position can be maintained regardless of the paper type, such as cut sheet paper or continuous sheet paper.

In addition, according to the present invention, the feeding of a thick recording medium, such as a post card, is ensured.

The ink jet head 20*j* has 128 ink ejection nozzles arranged in one row. When the ink jet head 20*j* is attached to the carriage 21, the arrangement of the nozzles is along the above described direction in which a recording medium is fed (hereafter, this will be referred to as a sub scan direction).

The ink jet recording apparatus in this embodiment can perform full color recording with yellow (Y), magenta (M), cyan (C) and black (Bk) ink, and monochrome recording with Bk ink.

In the arrangement for performing full color recording, the ink jet head 20*j* and ink tanks 20*t*, in which colored inks, Y, M, C, and Bk are respectively retained, are provided individually detachable from the carriage 21. When Y ink runs out or when the replacement of a tank is required, the pertinent tank can be replaced with another ink tank, or when the ink jet head 20*j* must be replaced, only the ink jet head need be changed.

With the above described structure, 128 ink ejection nozzles of the ink jet head 20*j* are assigned to each ink by the predetermined counts, and ink chambers and ink supply paths are individually formed in consonance with the assignments.

In the arrangement for performing monochrome recording, the ink jet head 20*j* and the ink tank 20*t* for Bk ink are integrally formed as one unit, which is provided detachable from the carriage 21.

The carriage 21 to which the ink jet head 20*j* and the ink tank 20*t* are attached can be shifted by the drive force produced by a carriage motor 22 that is transferred via a belt 23, which is connected to part of the carriage 21, as is shown in FIG. 1. By engaging a guide shaft 21*a* and a guide piece 21*b*, which are located in the horizontal direction in FIG. 2, to slide freely, the carriage 21 can be shifted along the guide shaft 21*a* and the guide piece 21*b*, and accordingly scanning for recording is possible. When no recording is performed, the carriage 21 is shifted back to a home position that is to the left in FIG. 1, and the face of the ink jet head 20*j* in which the ink ejection nozzles are arranged is capped with a capping unit 25.

The data for shifting the carriage 21 are detected by an encoder film 27, which is provided in parallel to the guide shaft 21*a*, and optical or magnetic encoder devices 51*a* and 51*b* (see FIG. 2) that are attached to the carriage 21 to sandwich the encoder film 27. An electric signal is transmitted from the apparatus body to the ink jet head 20*j* via a flexible circuit board 44.

In this embodiment, to ensure that a recording medium will be maintained flat even downstream along the feeding path from the recording position, a first spur is positioned opposite the discharge roller 14 with a recording medium between them, a second spur is positioned upstream along the feeding path from the first spur and downstream from the feeding roller 10, and the discharge roller 14, discharge means consisting of the two spurs, and a platen are located in the same plane.

As another arrangement to ensure that a recording medium will be maintained flat, a plurality of spurs are located at matrix positions in the main scan direction (the direction that is perpendicular to the feeding path).

The second embodiment of the present invention will now be described. The same reference numbers are used to denote the components in this embodiment that correspond to or are identical with those in the first embodiment, and no explanation for them will be given here.

Figure 12:
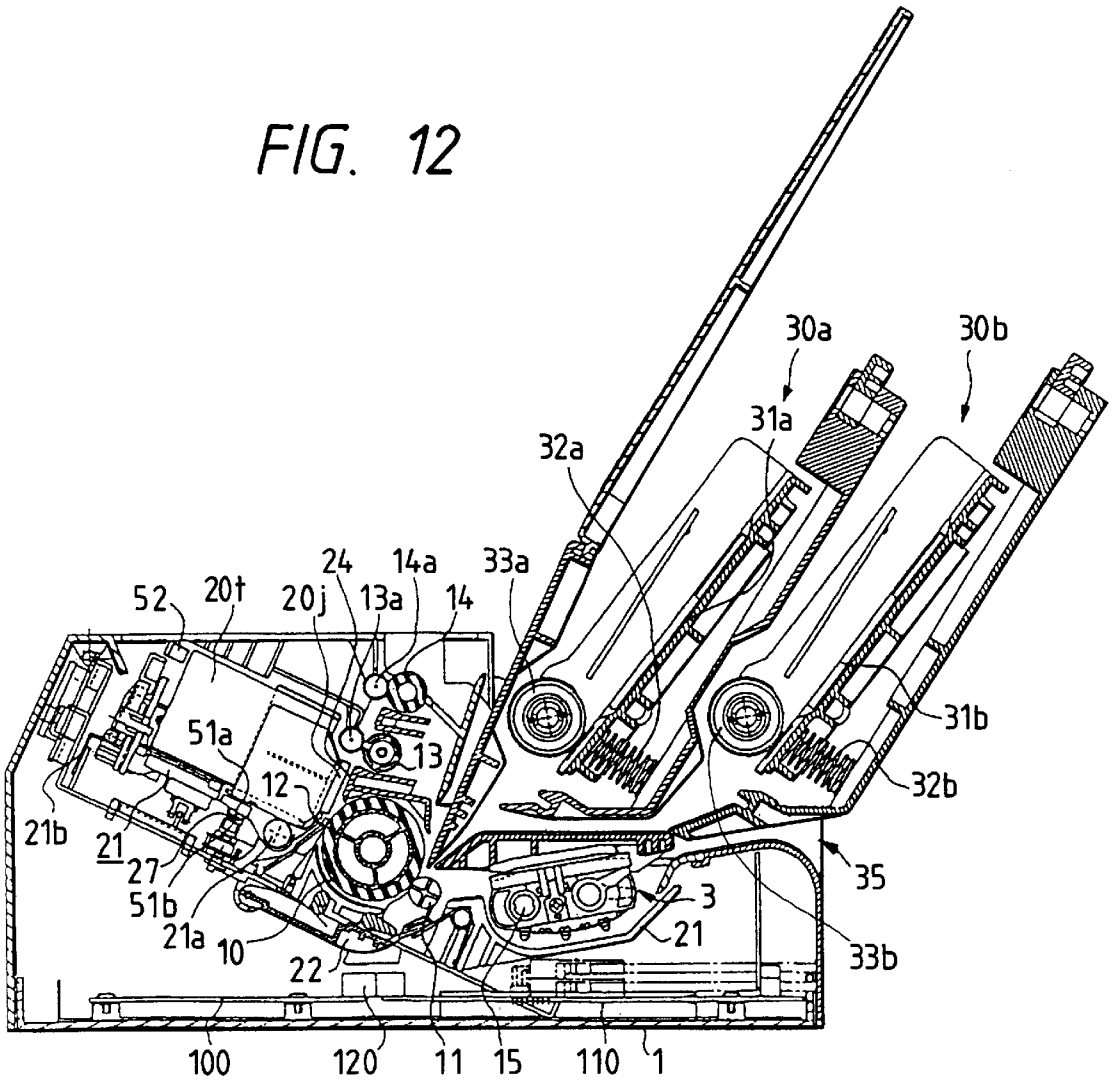
FIG. 12 is a cross sectional side view of a recording apparatus according to a second embodiment of the present invention when an automatic paper feeder is installed in the apparatus.
Figure 13:
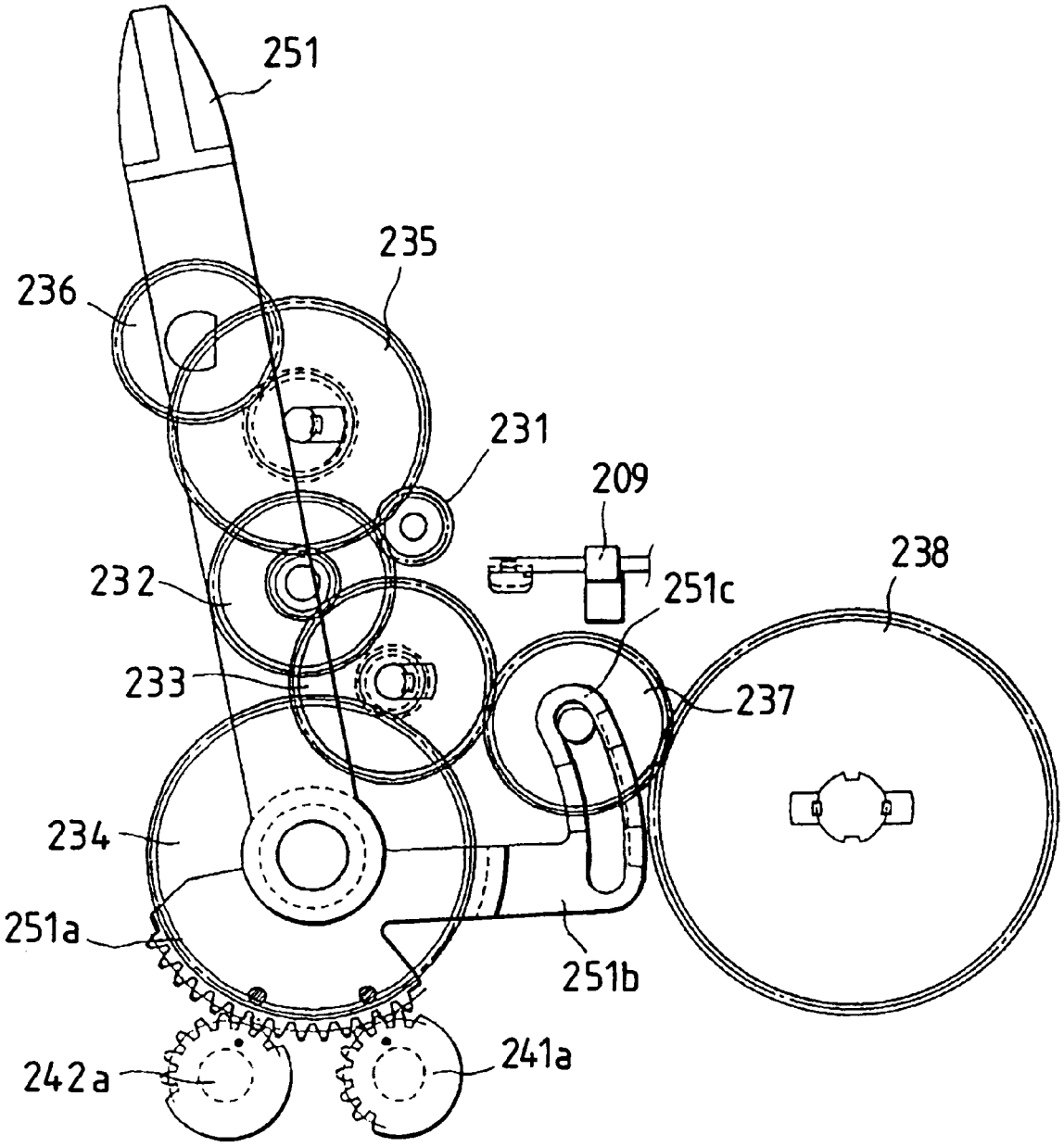
FIG. 13 is a side view for the arrangement of a paper feeding mechanism of the recording apparatus shown in FIG. 12 when cut sheet paper is selected.

In the second embodiment, as is shown in FIG. 12, a sheet is held on a feeding roller 10 by a resist roller 11 and a pinch roller 12.

Figure 14:
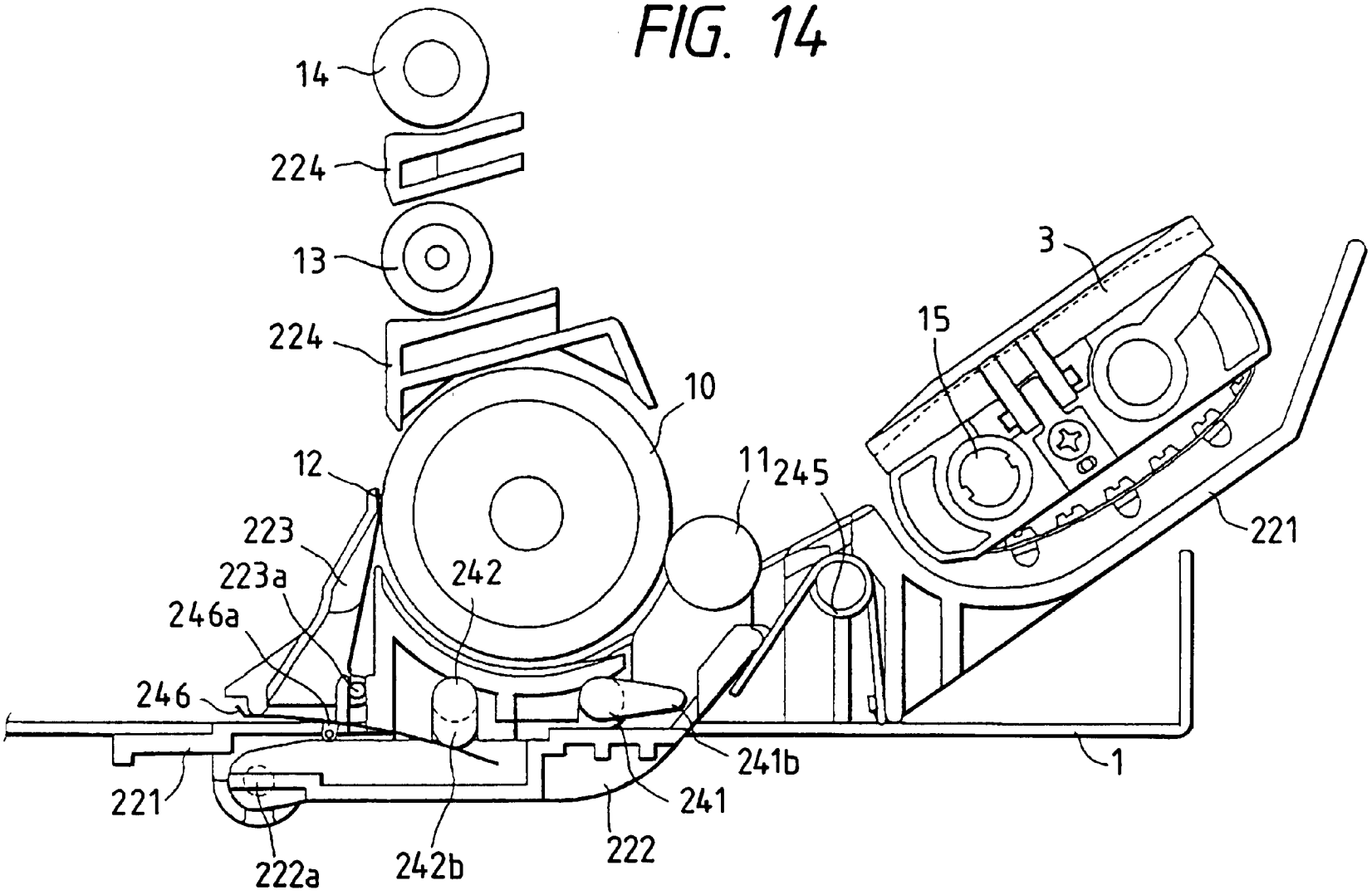
FIG. 14 is a cross sectional view of the paper feeding mechanism shown in FIG. 13.

When cut sheet paper is selected as a recording medium, a release lever 251 is set in a cut sheet select state, as is shown in FIGS. 13 through 15B, and then the resist roller 11 that is held by a resist roller holder 222 is pressed against the long feeding roller 10 by a resist roller spring 245 (see FIG. 14). The pinch roller 12 is held by a pinch roller holder 223, and is pressed against the feeding roller 10 by a pinch roller spring 246 (see FIG. 5).

The pinch roller spring 246 is bent at a protrusion 242*b* of a pinch roller release shaft 242 and generates pressing force by the spring elasticity at its support point 246*a*.

Figure 15A:
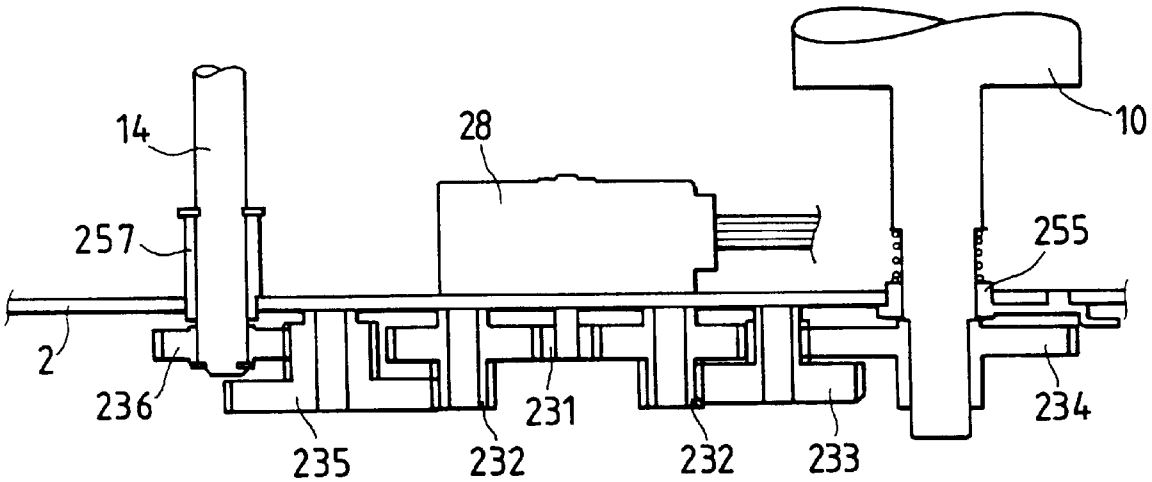
FIGS. 15A and 15B are development diagrams for the roller rows, with FIG. 15A showing how the drive force is transmitted to a feeding roller and FIG. 15B showing how the drive force is transmitted to a paper discharge roller.
Figure 15B:
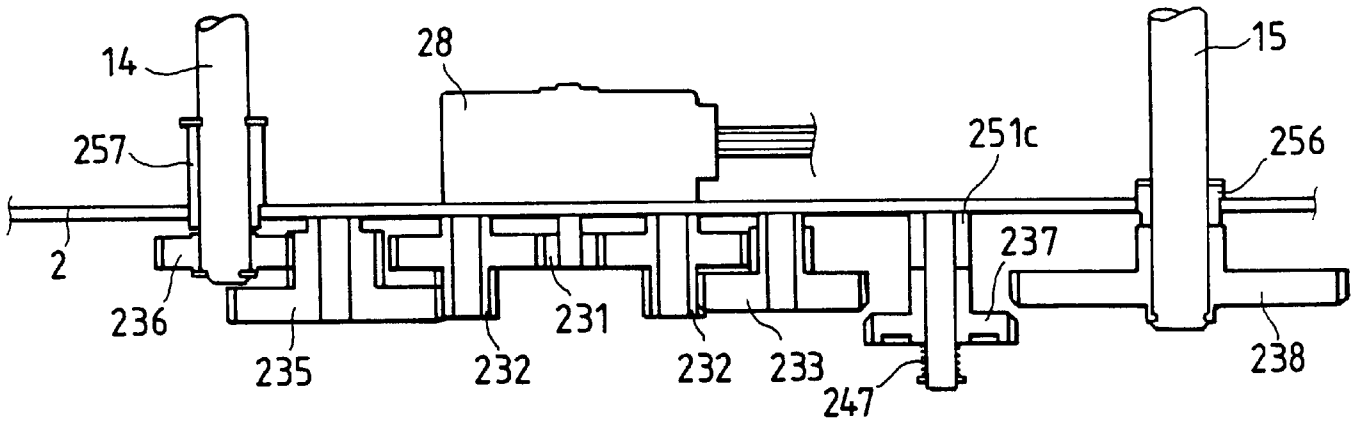

As for the transfer of the drive force of an LF motor 28 to a pin tractor 3, the drive force is transferred via an LF motor gear 231 and a deceleration gear 232 to an LF deceleration gear 233, but not up to the pin tractor 3 because the transfer between the LF deceleration gear 233 and a clutch gear 237 is cut off. More specifically, the clutch gear 237 is pushed toward a chassis 1 side (in a direction where the LF deceleration gear 233 is connected) by a clutch spring 247 that is shown in FIG. 15B. The clutch gear 237, however, is separated from the LF deceleration gear 233 against the urging force exerted by a cam 251*c* of a slide cam 251*b* that interlocks with the release lever 251.

The arrangement of the LF driving mechanism when continuous sheet paper is selected will now be described.

Figure 16:
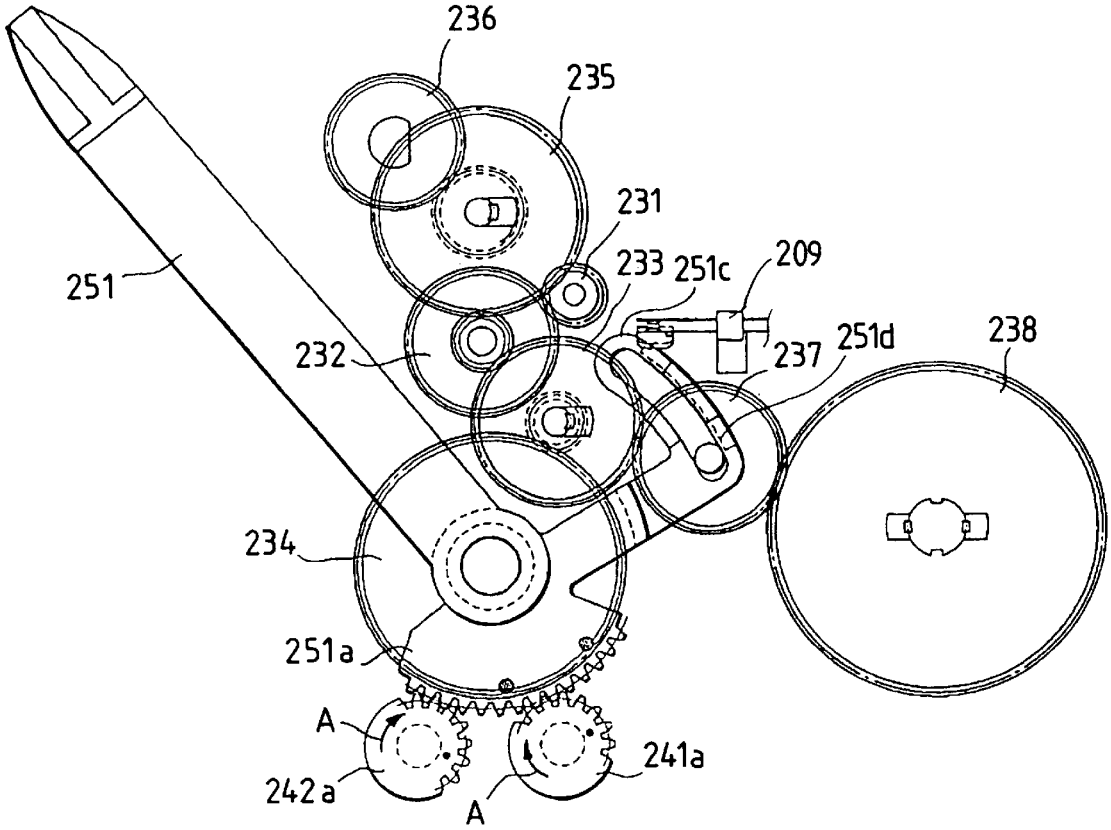
FIG. 16 is a side view for the arrangement of a paper feeding mechanism of the recording apparatus shown in FIG. 12 when continuous sheet paper is selected.

When the release lever 251 is pulled down to set the apparatus in the continuous sheet select state, as is shown in FIG. 16, a gear 241*a* of the resist roller release shaft 241 and a gear 242*a* of the pinch roller release shaft 242, both of which engage a gear 251*a* of the release lever 251, are rotated together in the direction indicated by the arrow A.

Figure 17:
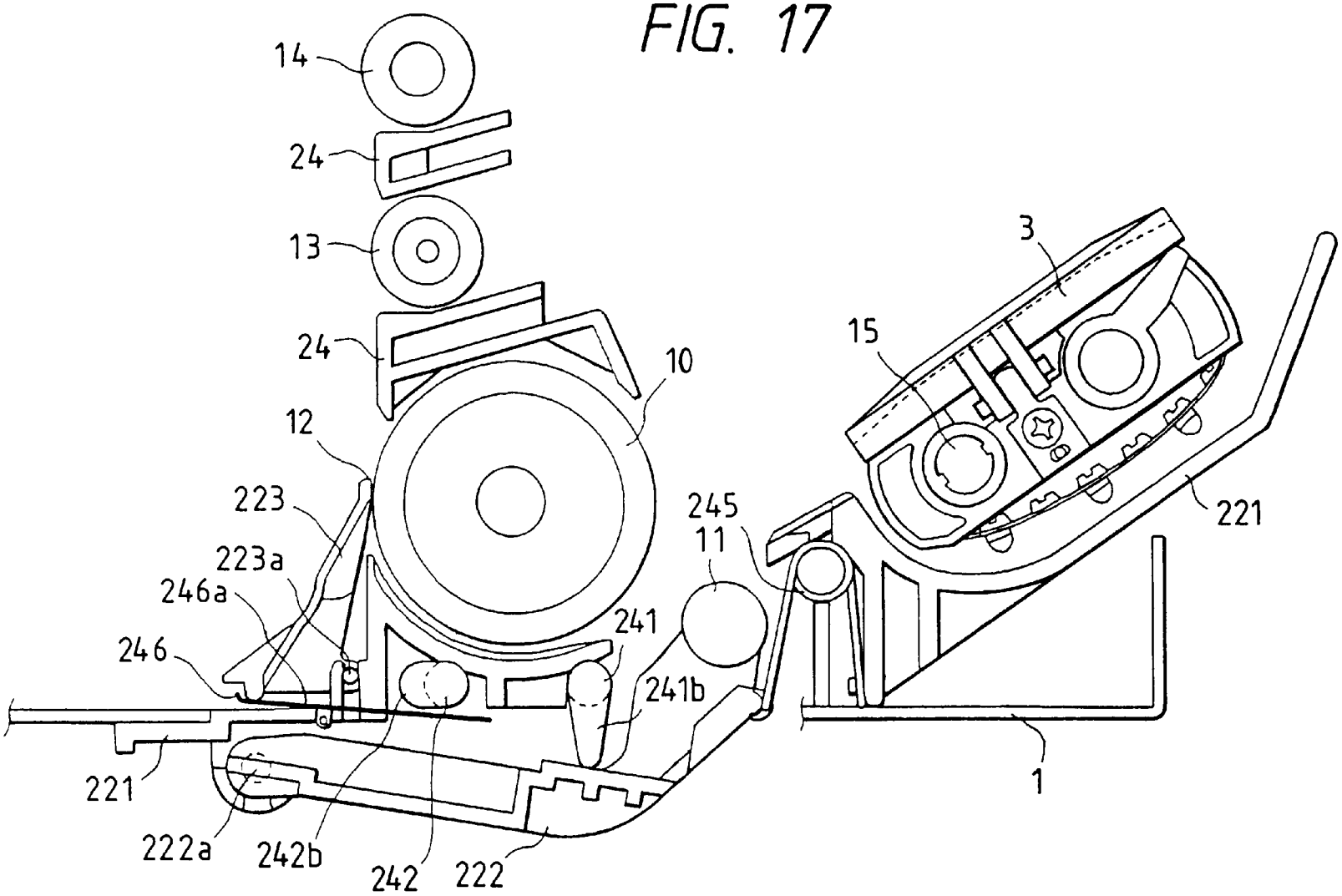
FIG. 17 is a cross sectional view of the paper feeding mechanism in FIG. 16.
Figure 18A:
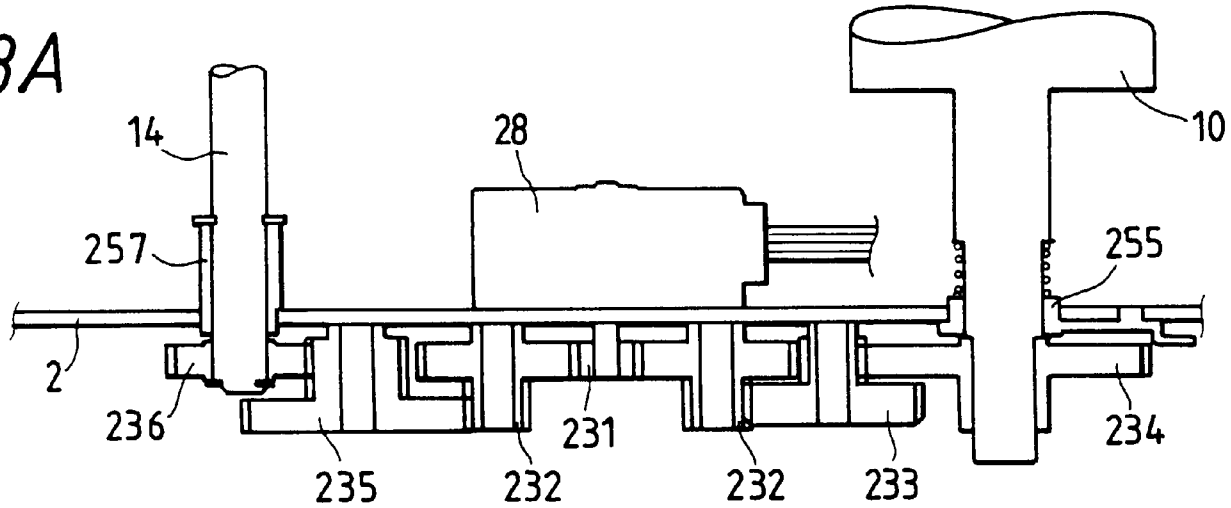
FIGS. 18A and 18B are development diagrams for the roller rows, with FIG. 18A showing how the drive force is transmitted to a feeding roller and FIG. 18B showing how the drive force is transmitted to a paper discharge roller.
Figure 18B:
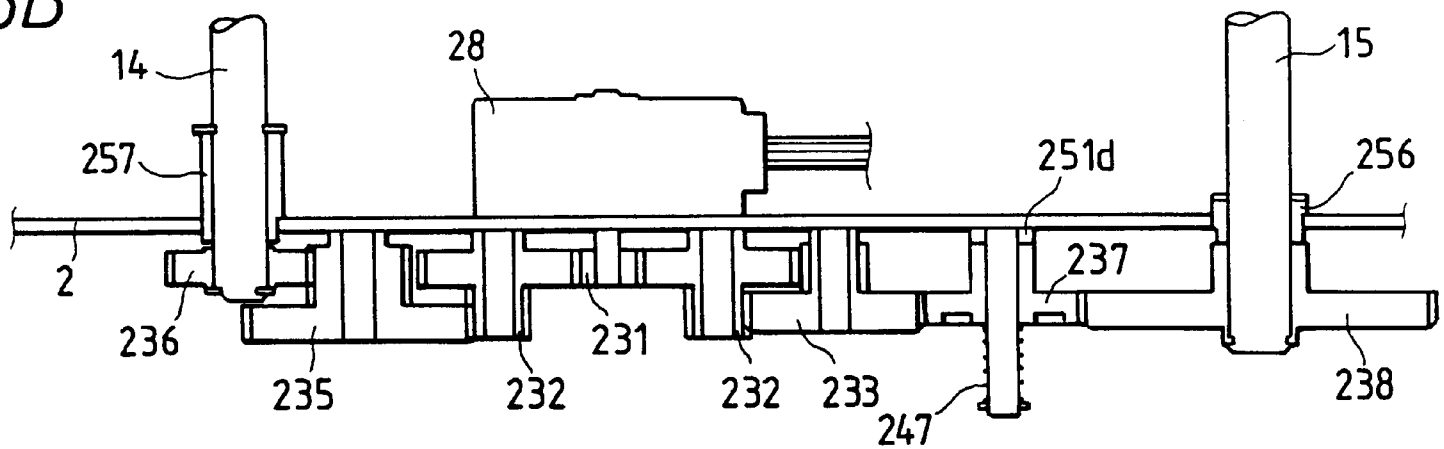

As the resist roller release shaft 241 is rotated, as is shown in FIG. 17, its protrusion 241*b* pushes the resist roller holder 222 to separate the resist roller 11 from the feeding roller 10 and to remove the resist roller 11 from the paper feeding path. As the pinch roller release shaft 242 is rotated, the pressure exerted by the protrusion 242*b* on the pinch roller spring 246 is released, and the pressing force exerted by the pinch roller 12 on the feeding roller 10 is accordingly reduced.

A reflective sensor 52 (see FIG. 12) is provided in part of the apparatus body, and is employed to read bar code information that adheres to an ink tank 20*t* or an ink jet head 20*j*. The ink tank 20*t* or the ink jet head 20*j* can thus be identified.

Figure 19:
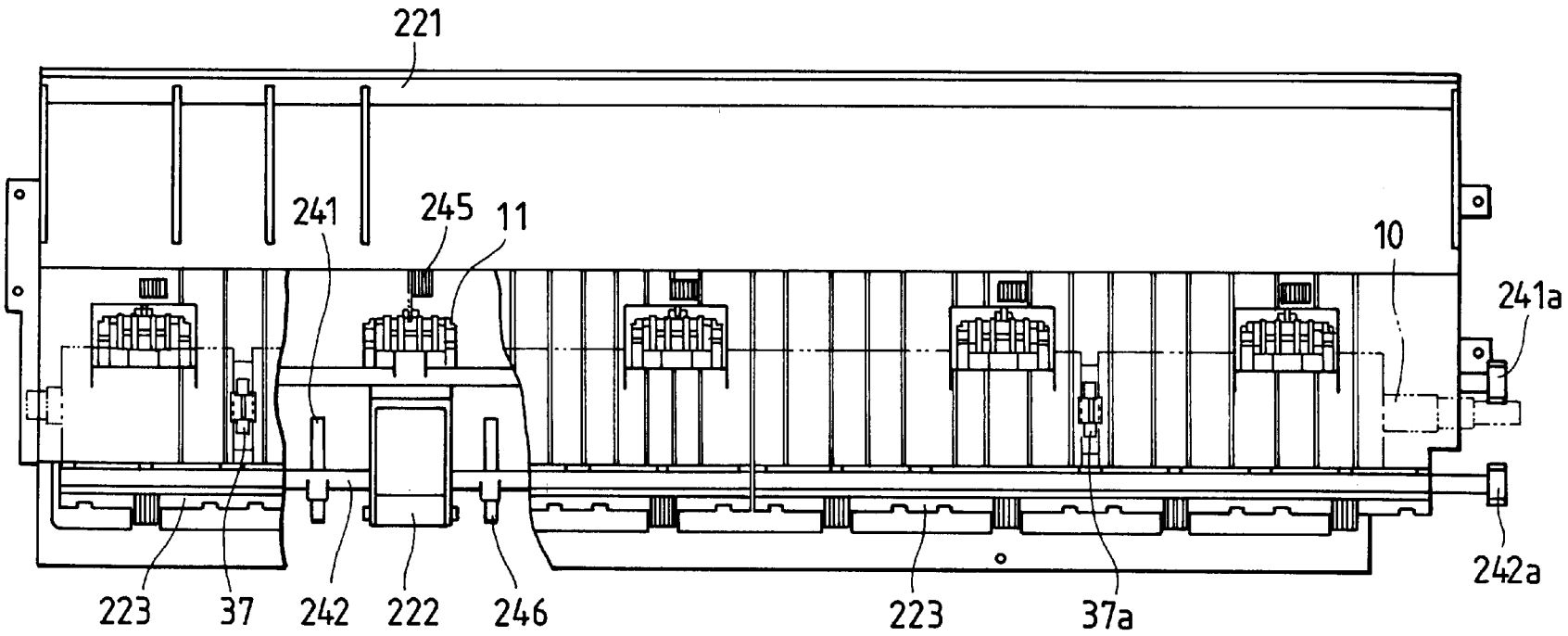
FIG. 19 is a top view illustrating the structure of a paper pan of the recording apparatus shown in FIG. 12.

The structure of a paper pan unit in this embodiment will now be explained while referring to FIG. 19.

Members and items in the unit are for a coupled driving feeding mechanism, and include a paper pan 221, the resist roller 11, the resist roller holder 222, the resist roller 245, the resist roller release shaft 241, the pinch roller 12, the pinch roller holder 223, the pinch roller spring 246, the pinch roller release shaft 242, and a paper sensor 37 that will be described later.

The unit is installed in the frame 2 from the bottom as viewed in FIG. 14. With this unit, (1) the assembly of the entire apparatus is easier, (2) the maintenance can be improved because of easy replacement of items, and (3) the number of assembly procedures can be reduced.

Since all the unit items are of the coupled driving type, the feeding accuracy of the unit does not differ from that when the items are formed as a unit. More specifically, as the drive transfer system, which includes the LF motor 28, and the feeding roller 10 are integrally formed in the apparatus body, the normal rotation of the feeding roller 10 is constantly maintained, and the coupled driving unit, which forces a recording medium into contact with the feeding roller 10 to generate the drive force, does not interfere with the rotation of the feeding roller 10.

The structure of the paper sensor in this embodiment will now be described while referring to FIGS. 20 and 21.

Figure 20:
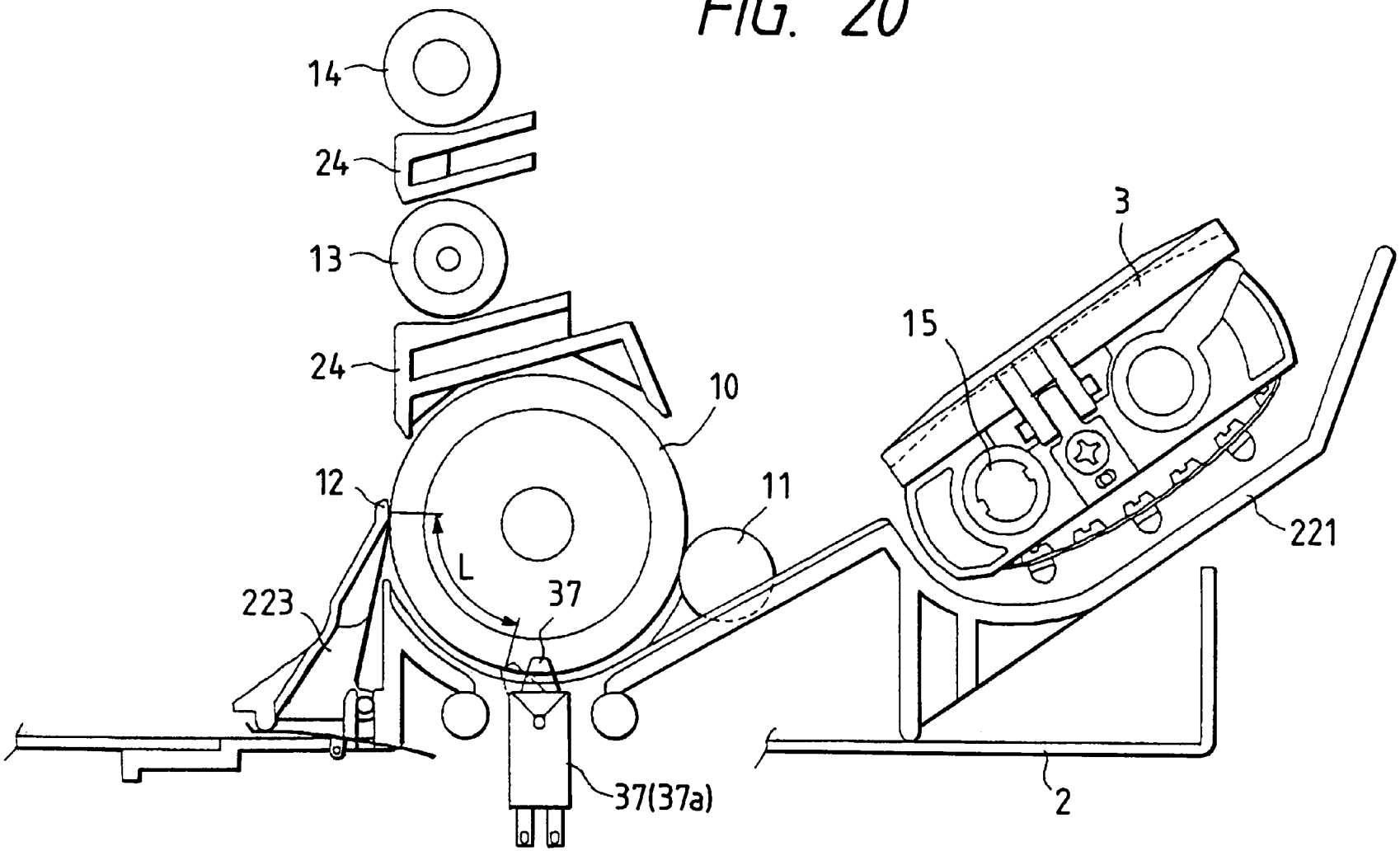
FIG. 20 is a cross sectional view for explaining the processing for a paper sensor in the paper feeding mechanism of the recording apparatus shown in FIG. 12 when cut sheet paper is selected.
Figure 21:
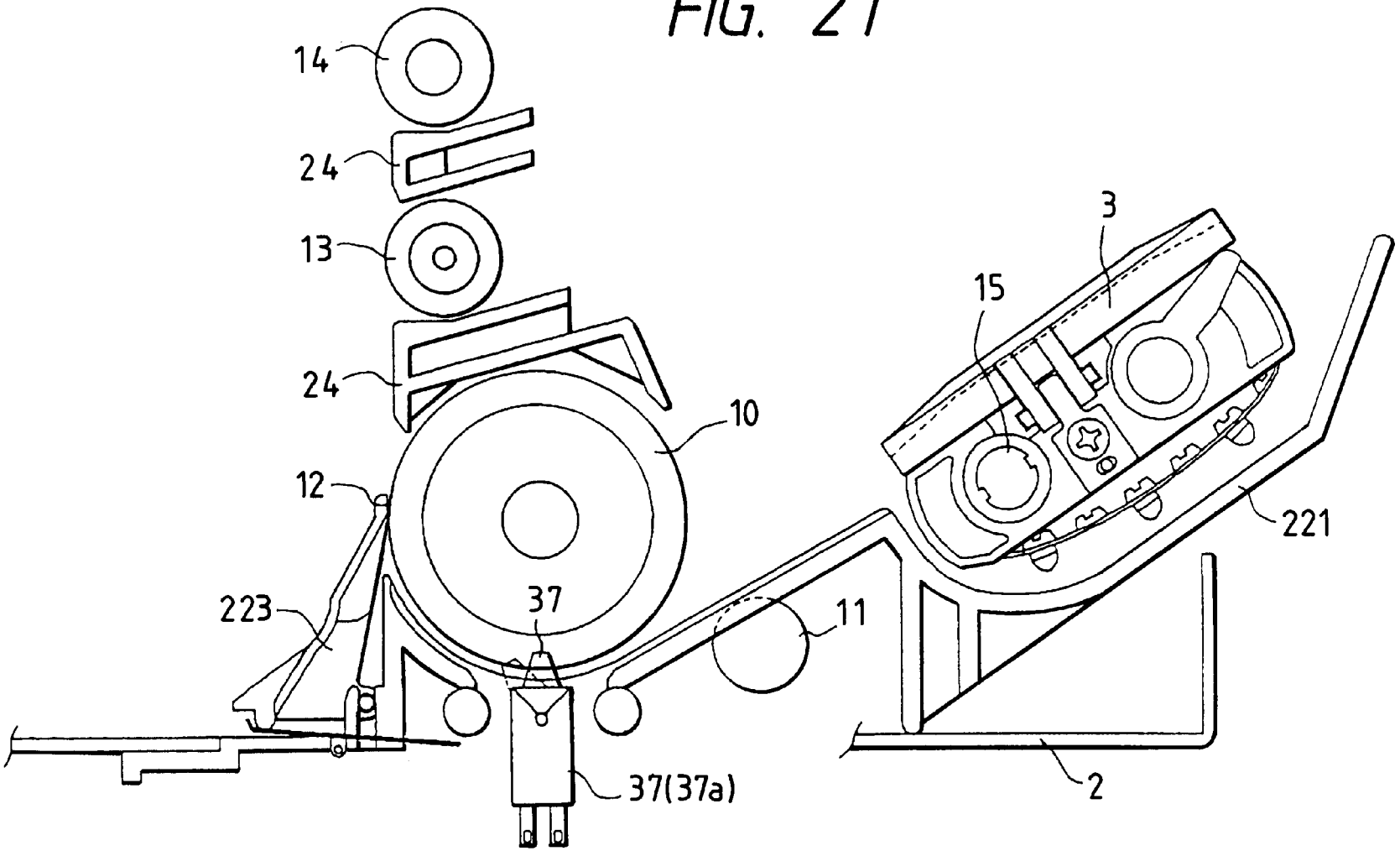
FIG. 21 is a cross sectional view for explaining the processing of a paper sensor in the paper feeding mechanism of the recording apparatus shown in FIG. 12 when continuous sheet paper is selected.
Figure 23:
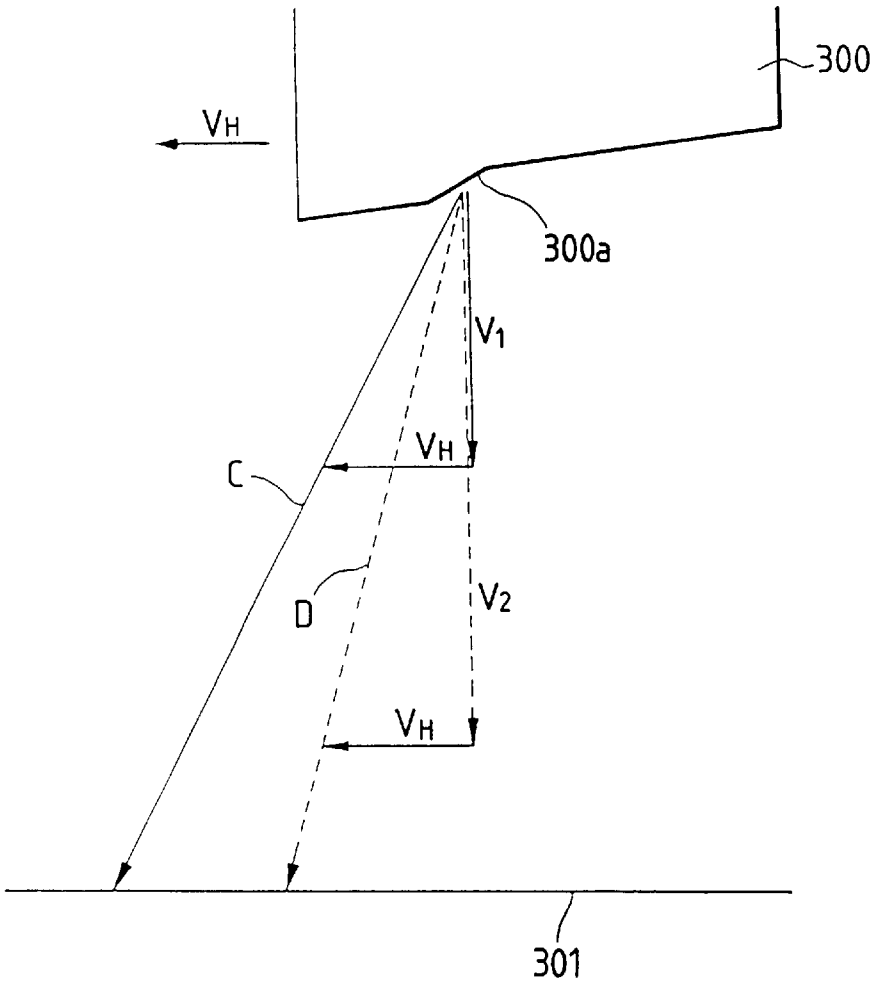
FIG. 23 PRIOR ART
FIG. 23 is a model diagram for explaining the occurrence of image split due to a difference in the speed at which ink is ejected from a recording head that is employed for an ink jet recording apparatus.
Figure 22:
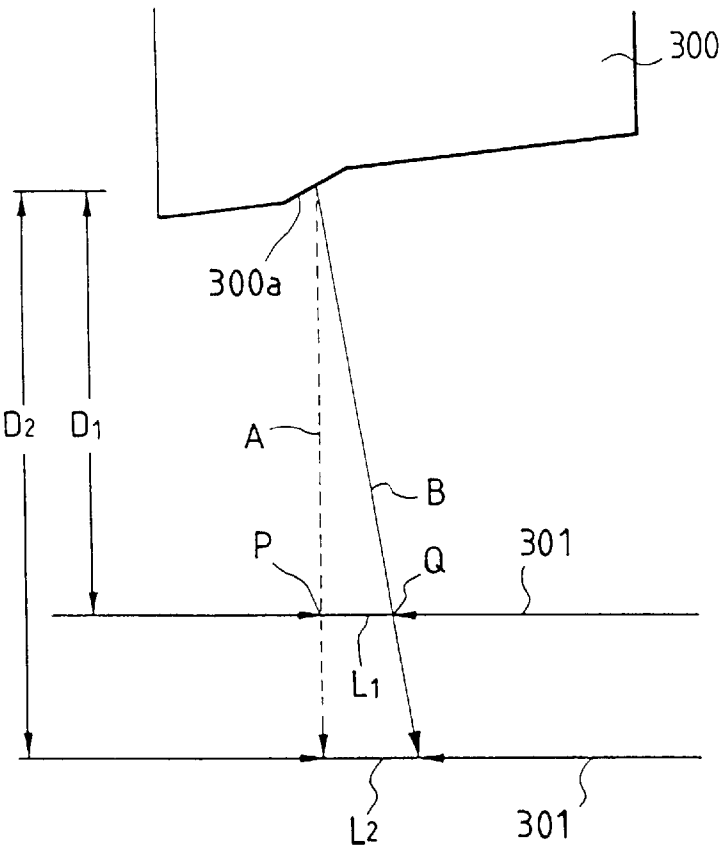
FIG. 22 is a model diagram for explaining the occurrence of a fuzzy image due to a shift in the direction ink is ejected from a recording head that is employed for an ink jet recording apparatus.
Figure 24:
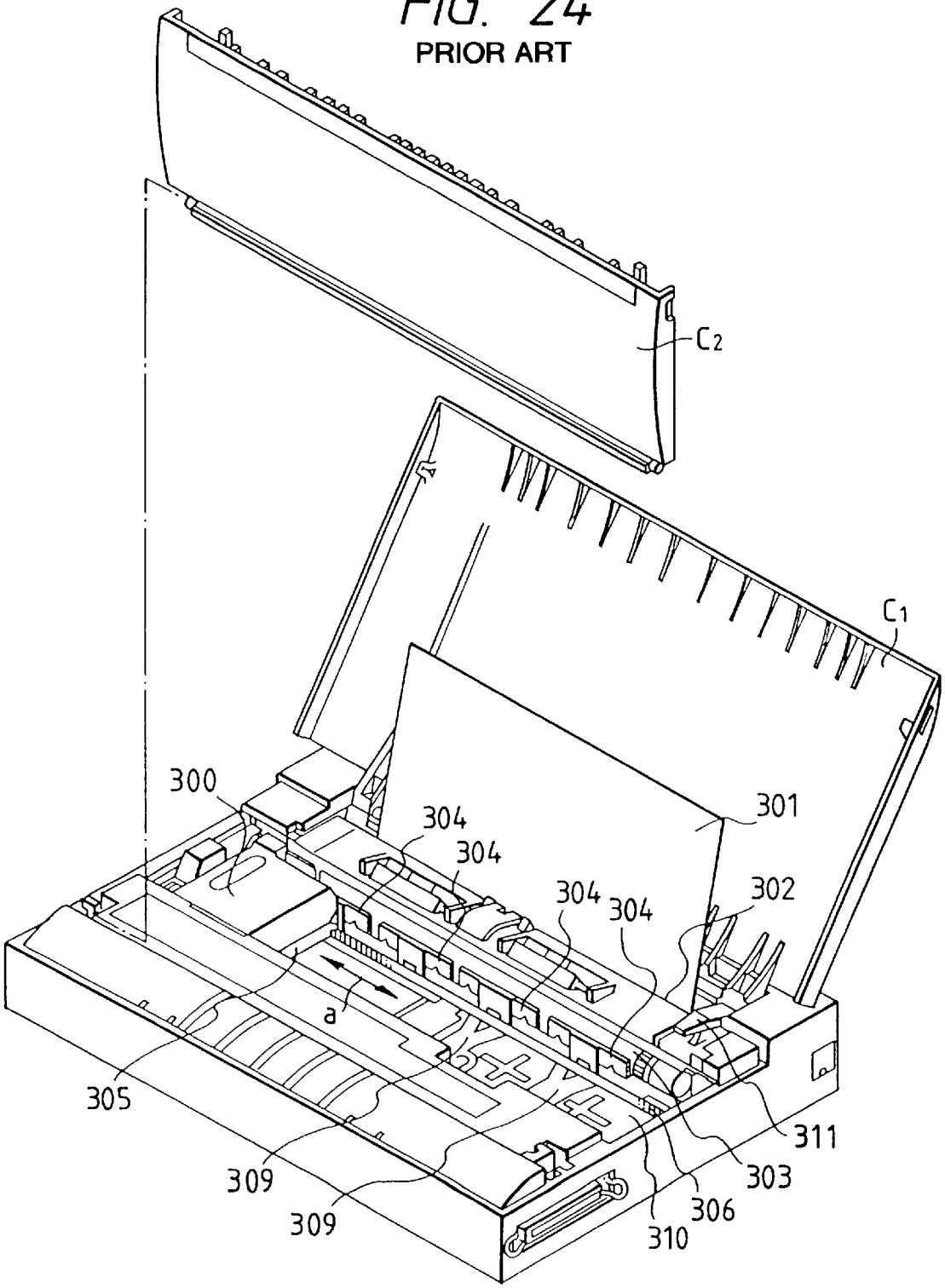
FIG. 24 PRIOR ART
FIG. 24 is a perspective view illustrating the structure of a conventional ink jet recording apparatus.
Figure 25A:
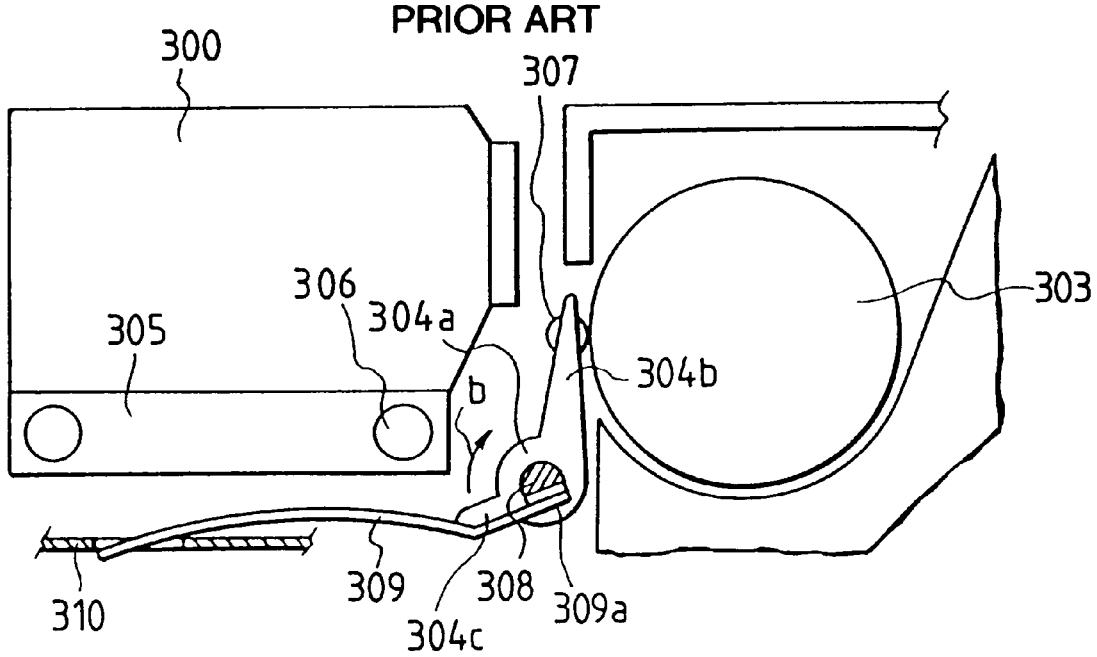
FIG. 25A PRIOR ART
FIGS. 25A and 25B are side views showing a paper pressing mechanism of the conventional recording apparatus shown in FIG. 14.
Figure 25B:
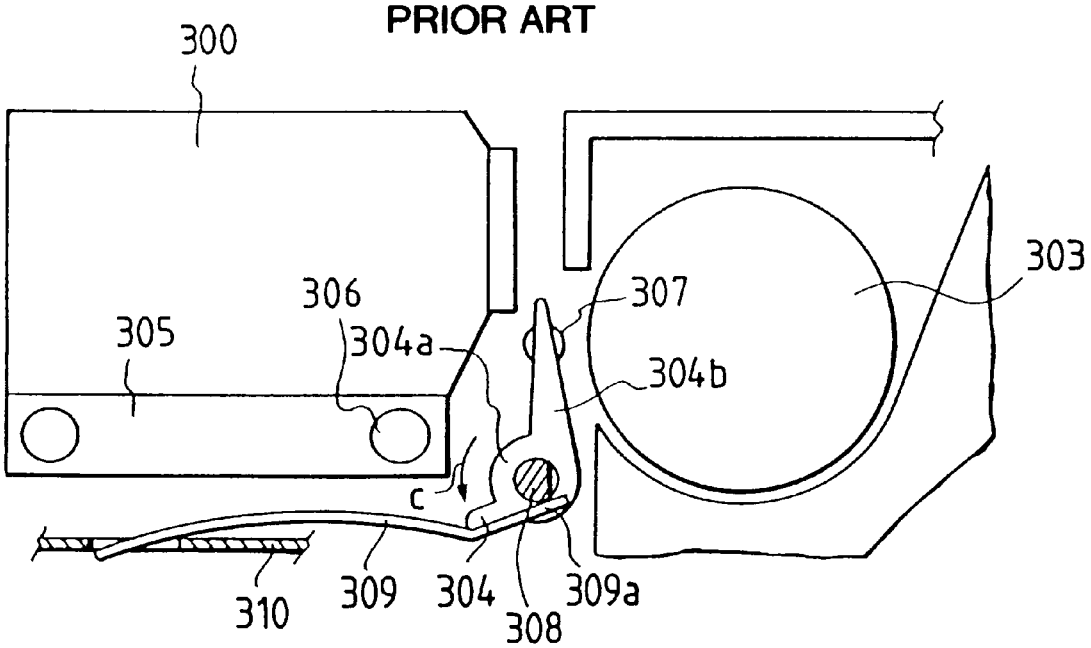
FIG. 25B PRIOR ART
Figure 26A:
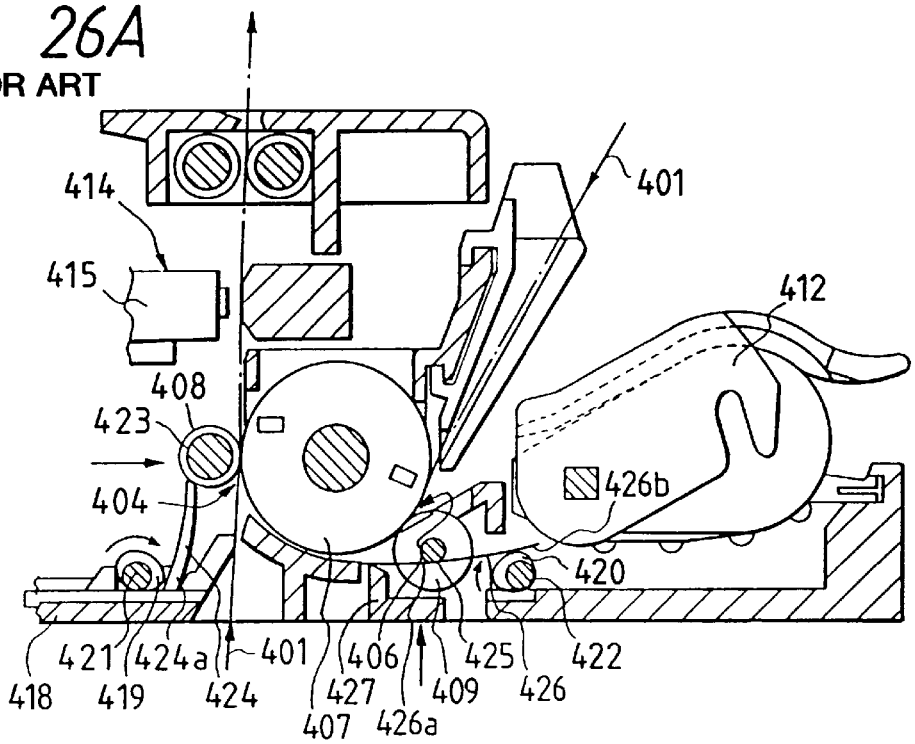
FIG. 26A PRIOR ART
FIGS. 26A and 26B are cross sectional views for the structure of a paper feeding mechanism of another conventional recording apparatus, with FIG. 26A showing the state where cut sheet paper is selected and FIG. 26B showing the state where continuous sheet paper is selected.
Figure 26B:
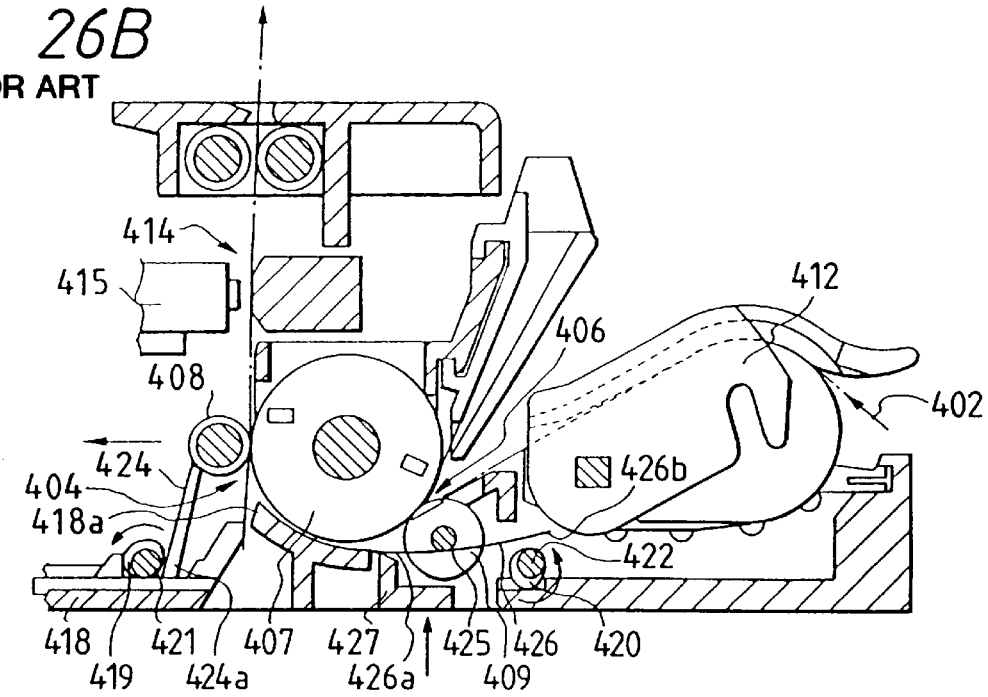
FIG. 26B PRIOR ART

The paper sensor 37 is located in the vicinity of the feeding path under the feeding roller 10, as is shown in FIGS. 20 and 21. The interval L from the position where the power sensor 37 detects a recording medium to the pinch roller 12 is determined to be twice a recording width in the feeding direction (the sub scan direction), which the ink jet head 20*j* can record by one scanning.

In this embodiment two level buffers for image recording data are provided to develop and process the recording data at high speed. More specifically, while recording data in the buffer at the first stage are to be recorded, recording data necessary for the next scanning are developed in the second stage buffer, so that time required for data development does not directly affect the scanning time for the ink jet head 20*j*. After the paper sensor 37 has detected the absence of a recording medium along the feeding path, a recording area that is at least twice a recording width in the feeding direction, which is available for the recording buffers, i.e., for one scanning recording, must be left in a recording medium.

Since in this embodiment a recording width in the feeding direction, which is available for one scanning, is 8.96 mm (1/360 inches×127 dots), with L of 27.5 mm, the above described requirement is satisfied.

Further, the paper sensor 37 in this embodiment is positioned ½ (50 mm) of the short side of a post card away from the paper reference position, so as to detect all types of paper. A paper type discrimination sensor 37*a* is positioned 335 mm away from the paper reference position and located at the same position as that of the paper sensor 37, as viewed in the cross section of the apparatus, so as to distinguish 80 digits of continuous sheet paper from 136 digits.

It should be noted that data that extend beyond a determined width for a recording region are discarded.

The feature of the LF motor 28 of the embodiment will now be described. The diameter of the LF motor 28 in the embodiment is designed smaller than that of the feeding roller 10. The reason for that setting is explained below.

[LF motor having a smaller diameter than that of a feeding roller]

Torque that is required for the acceleration of a motor is acquired by the following expression.

[Expression 1]

$$\tau = J/980 \times \pi/180 \times \theta \times (fn - f0)/tn + Tf$$

wherein

τ: required torque [g.cm]

J: driving mechanism inertia [g.cm$^2$]

θ: step angle [°]

fn: reached frequency [pps]

f0: activation frequency [pps]

tn: acceleration time [sec]

Tf: load torque [g.cm]

Tf is generated by the friction of the driving mechanism, and is characterized by the mechanical structure.

When the frequency fn is reached, the activation frequency f0, and the acceleration time tn are set to constant values and the mechanism is driven by a motor that has an identical step angle, the required torque τ is subject to the driving mechanism inertia J.

The driving mechanism inertia J is the sum of the rotor inertia Jr of the motor and inertia Jm of the other driving mechanism, and the required torque is therefore subject to the motor-rotor inertia Jr.

Although in general a high output=a high performance, since actually a large motor uses a lot of torque to drive the rotor of the motor, torque (output) that is supplied to the operation of the driving mechanism is reduced considerably more than was expected.

The following means are useful to reduce the rotor inertia of the motor.

(i) use magnetic powder with a small specific gravity;

(ii) reduce the diameter of a rotor;

(iii) reduce the thickness of a rotor;

(iv) do not provide magnetic powder for a portion that does not face a stator; and (v) decrease the specific gravity of a rotor.

Thus, a small, thin motor satisfies the above means.

Further, an advantage of a compact motor is that the maximum response frequency is high.

In this embodiment, fn=1800 [pps], f0=600 [pps], tn=16.758 [m.sec], and a motor of θ=7.5 [°] is employed. Further, a 2—2 phase exciting driving system is adopted to improve the angle accuracy. Therefore, a large motor has a low performance relative to a response frequency, and taking the specification of a product into account, employing a compact motor is more advantageous.

In this embodiment, with an external size ϕ35×thickness of 15 and with rotor material: Nd-Fe-B, rotor inertia Jr=2.5 [g.cm] is acquired and the motor driving is performed at a high speed and with a high output.

An ink jet recording system of the present invention comprises means (e.g., electrothermal energy conversion device or laser light) for generating thermal energy that is employed to perform ink ejection, and provides excellent effects where the ink status is varied by employing the thermal energy. This system can perform more delicate recording with a higher density.

For the specific arrangement and the principle, it is preferable to employ the basic principle that is disclosed in the specifications of, for example, U.S. Pat. No. 4,723,129 and U.S. Pat. No. 4,740,796. This system is applicable for both a so-called on-demand type and a continuous type. The system is especially effective with the ondemand type because at least one drive signal that corresponds to the image recording data, and that gives a rapid temperature rise which exceeds nucleate boiling, is supplied to an electrothermal energy conversion device that is positioned relative to a liquid (ink) bearing sheet and a liquid path. The thermal energy is thus generated by the electrothermal energy conversion device, and film boiling is effected on a thermally affected face of a recording head, so that bubbles in liquid (ink) can be formed in one-to-one correspondence with the drive signal. In consonance with the growth or shrinkage of the bubbles, liquid (ink) is discharged via an ejection opening and at least one droplet is formed. When the drive signal has a pulse form, the size of the bubble is immediately and properly altered, so that liquid (ink) which has an especially excellent response can be preferably ejected. An appropriate pulse drive signal is described in the specifications of U.S. Pat. No. 4,463,359 and U.S. Pat. No. 4,345,262. With the employment of the conditions that are described in the specification of U.S. Pat. No. 4,313,124, which relates to the temperature rising rate on the thermally affected face, even more excellent recording can be performed.

Besides the arrangement of a recording head, disclosed in the above described specifications, wherein the ejection ports, the liquid path, and the electrothermal energy conversion device are combined, the present invention also includes the arrangement disclosed in the specifications of U.S. Pat. No. 4,558,333 and U.S. Pat. No. 4,459,600, wherein a thermally acting portion is located in a curved area. In addition, the effects of the present invention can be obtained in the arrangements disclosed in Japanese Patent Application Laid-ODen No. 59-123670 wherein a common slit serves as an ejection portion for a plurality of electrothermal energy conversion devices; and in Japanese Patent Application Laid-Open No. 59-138461 wherein an opening in which a pressure wave of thermal energy is absorbed corresponds to an ejection portion. In other words, according to the present invention, recording is ensured to be efficiently performed regardless of the shape of a recording head.

The present invention is also applicable to a recording head of a full line type whose length corresponds to the maximum width of a recording medium that a recording apparatus can handle. Such a recording head may be a combination of a plurality of recording heads to attain the length, or may be one integrally formed recording head.

Moreover, the present invention is effective for the above described serial type recording head, a recording head that is fixed to the apparatus body, a replaceable, chip type recording head that can be electrically connected to the apparatus body or can receive ink from the apparatus body, or a cartridge type recording head for which an ink tank is integrally formed.

It is desirable that ejection recover means for a recording head, and extra auxiliary means be provided as additional components of the recording apparatus arrangement because the effect of the present invention can be provided more steadily. More specifically, capping means for a recording head, cleaning means, pressurizing or absorption means, extra heating means provided by employing an electrothermal energy conversion device or another heating device, or a combination of the two, and extra ejection means for discharging ink that is not required for the recording can be employed.

Although only one recording head is provided for a single ink, a plurality of recording heads may be mounted that correspond to a plurality of inks for which recording colors and densities differ. More specifically, the present invention is effective not only for the apparatus that has a recording mode with only a main color, black, but also for an apparatus that provides at least one full color mode, which has different color combinations or color mixture, with either an integrally formed recording head or a combination of a plurality of recording heads.

Further, although ink has been explained as a liquid in the above described embodiments of the present invention, ink that solidifies at room temperature or lower and that melts or liquefies at room temperature may be employed. Or, since an ink jet system generally maintains the temperature of ink within the range of 30° C. to 70° C. to hold the viscosity of ink within the steady ejection range, ink may be used that liquefies at the time of the execution of a recording signal. In addition, to aggressively prevent the temperature from rising due to thermal energy by employing that energy to liquefy solid ink, or to prevent the evaporation of ink, ink may be employed that solidifies while it settles down and is liquefied by heating. The present invention is available for ink that is liquefied by the application of thermal energy, such as ink that is liquefied by providing thermal energy in consonance with a recording signal and is then discharged, or ink that becomes solid by the time it reaches a recording medium. The ink in this case may be formed opposite an electrothermal energy conversion device while it is held as a liquid or a solid in a porous sheet recess or a through hole, as is described in Japanese Patent Application Laid-Open No. 54-56847 or Japanese Patent Application Laid-Open No. 60-71260. In the present invention, the above described film boiling system is the most effective for these ink types.

Further, an ink jet recording apparatus according to the present invention is employed as an image output terminal for a data processing apparatus, such as a computer, a copy machine that is combined with a reader, or a facsimile that has a communication function.

As described above, the present invention ensures that a recording medium can be maintained flat during the feeding process and during the recording process, regardless of whether the recording medium is cut sheet paper or continuous sheet paper, and can prevent distortion and thus provide high quality image recording.

What is claimed is:

1. A recording apparatus comprising:

recording means for recording an image on a recording medium in consonance with an image signal;

feeding means for feeding said recording medium downstreamly to said recording means;

first auxiliary feeding means which is provided around said feeding means upstream of said recording means, and which contacts said feeding means for pressing said recording medium against said feeding means when said recording medium is cut sheet paper, but which is separated from said feeding means when said recording medium is continuous sheet paper in order to form a feeding route for said continuous sheet paper;

second auxiliary feeding means, which is provided around said feeding means in the vicinity of said recording means, and which contacts said feeding means for pressing said recording medium against said feeding means when said recording medium is cut sheet paper, but which while maintaining a contact position with said feeding means, decreases pressure against said feeding means when said recording medium is continuous sheet paper; and third auxiliary feeding means, which is provided around said feeding means between said first auxiliary feeding means and said second auxiliary feeding means, and which contacts said feeding means for pressing said recording medium against said feeding means when said recording medium is cut sheet paper, but which decreases pressure against said feeding means when said recording medium is continuous sheet paper;

switching means for separating said first auxiliary feeding means away from said feeding means, and for decreasing pressure of said second auxiliary feeding means and third auxiliary feeding means against said feeding means; and a paper sensor for detecting arrival of paper, said paper sensor located almost immediately downstream of said third auxiliary feeding means and upstream of said recording means in the paper feeding direction, wherein pressure forces that are applied by said first auxiliary feeding means, said second auxiliary feeding means, and said third auxiliary feeding means to said feeding means are independently set.

2. A recording apparatus according to claim 1, wherein said switching means separates said first auxiliary feeding means away from said feeding means, and decreases pressure of said second auxiliary feeding means and said third auxiliary feeding means against said feeding means in sync with the separation of said first auxiliary feeding means.

3. A recording apparatus according to claim 2, wherein said switching means includes a cam shaft and a lever that rotates said cam shaft.

4. A recording apparatus according to one of claims 1, 2 and 3, wherein said feeding means is a roller that is elongated in a main scanning direction that is perpendicular to a feeding direction for said recording medium.

5. A recording apparatus according to claim 4, wherein said recording means is mounted detachable from a conveying base that reciprocates along said main scanning directions.

6. A recording apparatus according to claim 5, a tank in which at least one kind of ink to be supplied to said recording means is retained is provided detachable from said recording means.

7. A recording apparatus according to one of claims 1, 2 and 3, wherein said recording means has an electrothermal energy conversion device, which generates thermal energy that causes film boiling of ink, that serves as an element that generates energy for ink ejection.

8. A recording apparatus according to claim 1, further comprising pressure urging means for independently supplying pressure to said first auxiliary feeding means, said second auxiliary feeding means and said third auxiliary feeding means, wherein said switching means separates said first auxiliary feeding means away from said feeding means and decreases said pressure of said second auxiliary feeding means and said third auxiliary feeding means against said feeding means in sync with the separation of said first auxiliary feeding means.

9. A recording apparatus according to claim 8, wherein said switching means includes a cam shaft and a lever that rotates said cam shaft.

10. A recording apparatus according to one of claims 1, 8 and 9, wherein said feeding means is a roller that is elongated in a main scanning direction that is perpendicular to a feeding direction for said recording medium.

11. A recording apparatus according to claim 10, wherein said recording means is mounted detachable from a conveying base that reciprocates along said main scanning directions.

12. A recording apparatus according to claim 11, wherein a tank in which at least one kind of ink to be supplied to said recording means is retained is provided detachable from said recording means.

13. A recording apparatus according to one of claims 1, 8 and 9, wherein said recording means has an electrothermal energy conversion device, which generates thermal energy that causes film boiling of ink, that serves as an element that generates energy for ink ejection.

14. A sheet feeding device comprising:

a feeding rotary body for feeding sheet paper;

guide means for forming a feeding path, along which said sheet paper is turned in the circumferential direction of said feeding rotary body and for guiding said sheet paper along an external surface of said feeding rotary body;

a first rotary body, a second rotary body, and a third rotary body, sequentially located from upstream to downstream on said feeding path, around said feeding rotary body, for pressing said sheet paper against said feeding rotary body, and rotating following to the sheet paper fed by said feeding rotary body;

detection means, positioned between said second rotary body and said third rotary body, for detecting conveyance of said sheet paper;

separating/decreasing means for separating said first rotary body away from said feeding rotary body and for decreasing pressure of the second rotary body and third rotary body against said feeding rotary body; and pressure urging means for urging said first rotary body, said second rotary body and said third rotary body to press said sheet paper against said feeding rotary body, said pressure urging means located either at a release position where pressure is almost released by said separating/decreasing means or at a pressurizing position where pressure at said release position is gradually increased, wherein pressure forces that are applied by said first rotary body, said second rotary body, and said third rotary body to said feeding rotary body are independently set.

15. A sheet feeding device according to claim 14, wherein said detection means is located almost immediately after said second rotary body.

16. A sheet feeding device according to claim 14, wherein said first rotary body and said third rotary body are positioned almost opposite each other with said feeding rotary body inbetween.

17. A sheet feeding device according to claim 14, further comprising recording means for recording an image on said sheet paper that is fed to said feeding rotary body.

18. A sheet feeding device according to claim 14, wherein the rotational centers of said first rotary body and said third rotary body and said feeding rotary body lie on almost a straight line, and said rotary body is positioned almost mid way between said first rotary body and said third rotary body.

19. A sheet feeding device according to claim 18, wherein said detection means is located almost immediately after said second rotary body.

20. A sheet feeding device comprising:

a feeding rotary body for feeding sheet paper;

guide means for forming a feeding path, along which said sheet paper is turned in the circumferential direction of said feeding rotary body and for guiding said sheet paper along an external surface of said feeding rotary body;

a first rotary body, a second rotary body and a third rotary body, sequentially located from upstream to downstream on said feeding path around said feeding rotary body, for pressing said sheet paper against said feeding rotary body, and rotating following to the sheet paper fed by said feeding rotary body;

separation means for separating said first rotary body from said feeding rotary body from said feeding rotary;

a tractor for feeding continuous sheet paper to said feeding rotary body;

a clutch for selectively transmitting a drive force to said tractor, said clutch being switched to the connected state in synchronization with an operation of said separation means, which separates said first rotary body from said feeding rotary body;

separating/decreasing means for separating said first rotary body away from said feeding rotary body and for decreasing pressure of the second rotary body and the third rotary body against said feeding rotary body;

pressure urging means for urging said first rotary body, said second rotary body and said third rotary body to press said sheet paper against said feeding rotary body, said pressure urging means being located either at a release position where pressure is almost released by said separating/decreasing means or at a pressurizing position where pressure at said release position is gradually increased; and a paper sensor for detecting arrival of paper before image forming means, said paper sensor located downstream of said third rotary body in the paper feeding direction, wherein pressure forces that are applied by said first rotary body, said second rotary body and said third rotary body to said feeding rotary body are independently set.

21. A sheet feeding device according to claim 20, wherein synchronization with the operation of said separation means to separate said first rotary body from said feeding rotary body, a pressing force exerted by said second rotary body and said third rotary body on said feeding rotary body is decreased.

22. A sheet feeding device according to claim 20, further comprising recording means for recording an image on said sheet that is fed by said feeding rotary body.

* * * * *

UNITED STATES PATENT AND TRADEMARK OFFICE

CERTIFICATE OF CORRECTION

PATENT NO. : 5,984,469

DATED : November 16, 1999

INVENTOR(S): YASUSHI KOIKE, ET AL.

It is certified that error appears in the above-identified patent and that said Letters Patent is hereby corrected as shown below:

COVER PAGE AT ITEM [57] ABSTRACT:
Line 4, "contact" should read --contacts--.

COVER PAGE AT ITEM [56] RC:
Foreign Patent Documents: "54-123670" should read --59-123670--.

COLUMN 2:
Line 40, "prevents" should read --prevent--.

COLUMN 10:
Line 30, "an" (2nd occurrence) should read --a--.

COLUMN 16:
Line 22, "ondemand" should read --on-demand--; and
Line 53, "Laid-ODen" should read --Laid-Open--.

COLUMN 18:
Line 2, "streamly" should read --stream--;
Line 59, "claim 5," should read --claim 5, further comprising--; and
Line 61, "retained" should read --retained, and which--.

UNITED STATES PATENT AND TRADEMARK OFFICE

CERTIFICATE OF CORRECTION

PATENT NO. : 5,984,469

DATED : November 16, 1999

INVENTOR(S): YASUSHI KOIKE, ET AL.

It is certified that error appears in the above-identified patent and that said Letters Patent is hereby corrected as shown below:

COLUMN 20:

Line 2, "inbetween." should read --in between.--.

Signed and Sealed this

Seventeenth Day of October, 2000

*Attest:*

Q. TODD DICKINSON

*Attesting Officer*

*Director of Patents and Trademarks*